US011740055B1

(12) United States Patent
Choiniere et al.

(10) Patent No.: US 11,740,055 B1
(45) **Date of Patent: *Aug. 29, 2023**

(54) RADIO FREQUENCY/ORTHOGONAL INTERFEROMETRY PROJECTILE FLIGHT MANAGEMENT TO TERMINAL GUIDANCE WITH ELECTRO-OPTICAL HANDOFF

(71) Applicant: BAE Systems Information and Electronic Systems Integration Inc., Nashua, NH (US)

(72) Inventors: Michael J. Choiniere, Merrimack, NH (US); Ira B. Ekhaus, Arlington, MA (US); Quang M. Lam, Fairfax, VA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 847 days.

This patent is subject to a terminal disclaimer.

(21) Appl. No.: 16/587,516

(22) Filed: Sep. 30, 2019

Related U.S. Application Data

(60) Provisional application No. 62/738,016, filed on Sep. 28, 2018, provisional application No. 62/738,082, filed on Sep. 28, 2018.

(51) Int. Cl.
*F41G 7/28* (2006.01)
*F41G 7/22* (2006.01)

(52) U.S. Cl.
CPC ..... *F41G 7/28* (2013.01); *F41G 7/226* (2013.01); *F41G 7/2293* (2013.01)

(58) Field of Classification Search
CPC ..... F41G 7/28; F41G 7/226; F41G 7/2293
See application file for complete search history.

(56) References Cited

U.S. PATENT DOCUMENTS

| | | | | |
|---|---|---|---|---|
| 6,076,765 | A * | 6/2000 | Horwath | G01S 3/788 244/3.16 |
| 8,120,526 | B2 | 2/2012 | Holder | |
| 8,854,252 | B2 | 10/2014 | Holder | |
| 9,401,741 | B2 | 7/2016 | Holder et al. | |
| 9,696,418 | B2 | 7/2017 | Holder | |
| 10,012,477 | B1 * | 7/2018 | Ell et al. | F41G 7/2253 |
| 11,047,958 | B1 * | 6/2021 | Choiniere | G01S 7/4818 |
| 11,199,380 | B1 * | 12/2021 | Ekhaus et al. | F41G 7/226 |

(Continued)

FOREIGN PATENT DOCUMENTS

WO 2007/016098 A2 2/2007

OTHER PUBLICATIONS

"Heterodyne", https://en.wikipedia.org/wiki/Heterodyne, known of at least since Apr. 24, 2019.
"Interferometry", https://en.wikipedia.org/wiki/Interferometry, known of at least since Apr. 24, 2019.
"Monopulse radar", https://en.wikipedia.org/wiki/Monopulse radar, known of at least since Apr. 24, 2019.
"Pulse-Doppler signal processing", https://en.wikipedia.org/wiki/Pulse-Doppler_signal_processing, known of at least since Apr. 24, 2019.

(Continued)

*Primary Examiner* — Marcus E Windrich
(74) *Attorney, Agent, or Firm* — Scott J. Asmus; KPIP Law, PLLC

(57) ABSTRACT

The system and method of projectile flight management using a combination of radio frequency orthogonal interferometry for the long range navigation and guidance of one or more projectiles and a short range navigation and guidance system to provide for more accurate targeting, especially in GPS-denied and GPS-limited environments.

18 Claims, 15 Drawing Sheets

(56) References Cited

U.S. PATENT DOCUMENTS

| | | | | |
|---|---|---|---|---|
| 11,221,194 | B2 | 1/2022 | Lam et al. | |
| 11,287,520 | B1 | 3/2022 | Ekhaus | |
| 2007/0241227 | A1* | 10/2007 | Zemany et al. ..... | F41G 7/2293 244/3.1 |
| 2017/0227330 | A1* | 8/2017 | Tomich et al. ..... | F41G 7/2233 |
| 2017/0314892 | A1* | 11/2017 | Holder ..... | G01S 13/42 |
| 2019/0033440 | A1 | 1/2019 | Boolos et al. | |
| 2020/0256643 | A1* | 8/2020 | Schorr et al. ..... | F41G 7/008 |
| 2021/0270570 | A1* | 9/2021 | Choiniere et al. ..... | F41G 7/008 |
| 2021/0312639 | A1* | 10/2021 | Choiniere ..... | G06T 7/207 |

OTHER PUBLICATIONS

"Undersampling", https://en.wikipedia.org/wiki/Undersampling, known of at least since Apr. 24, 2019.

Doerry, "SAR Processing with Stepped Chirps and Phased Array Antennas", SANDIA REPORT, Sandia National Laboratories, Printed Sep. 2006, Albuquerque, NM.

Radhakrishnan et al., "Bearing only Tracking of Maneuvering Targets using a Single Coordinated Turn Model", International Journal of Computer Applications (0975-8887) Volume 1 - No. 1, pgs. 25-33; 2010.

Mallick et al., "Angle-only filtering in 3D using Modified Spherical and Log Spherical Coordinates", 14th International conference on Information Fusion, Chicago, Illinois; pgs. 1905-1912, Jul. 5-8, 2011.

* cited by examiner

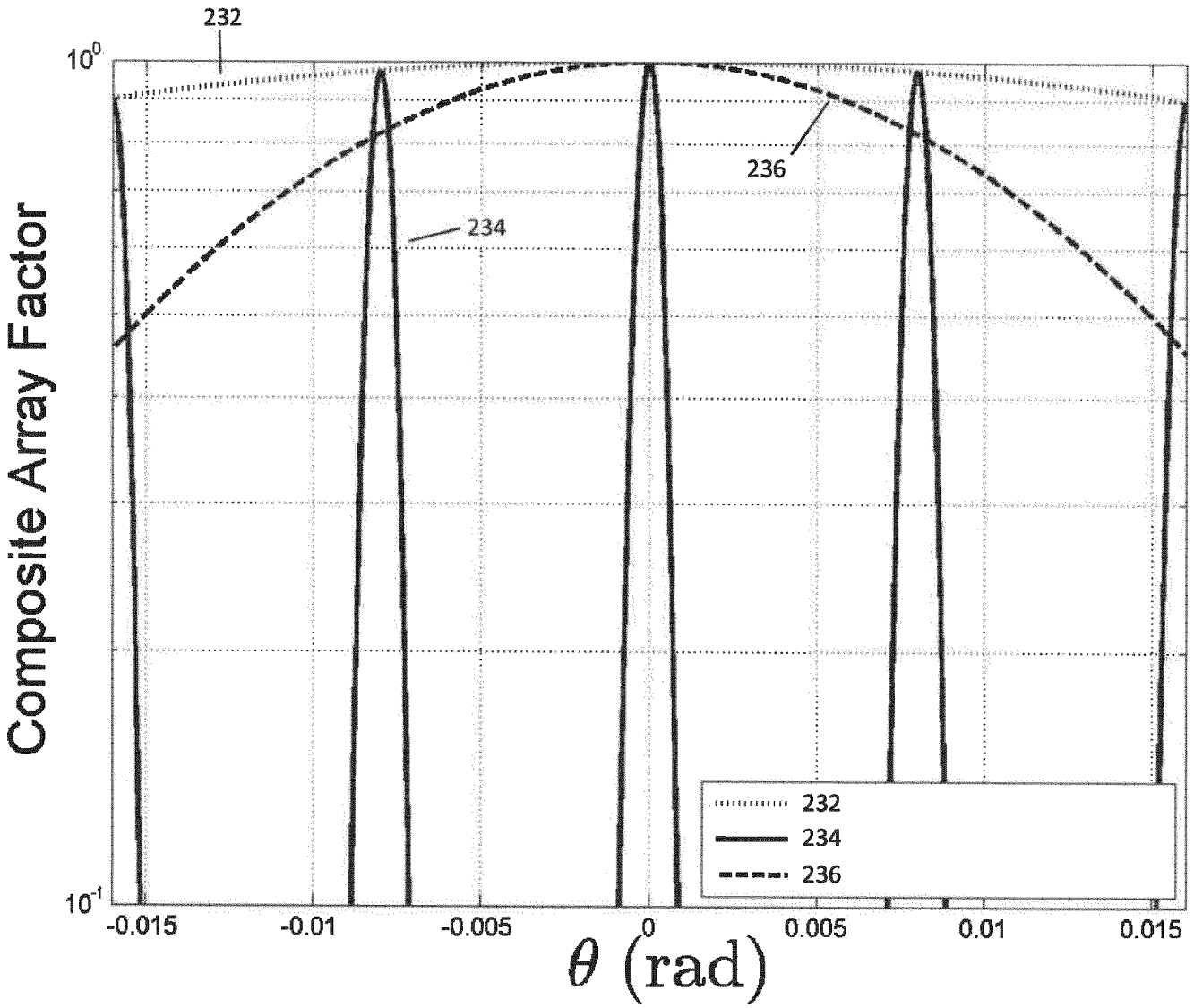
FIG 2.E

RADIO FREQUENCY/ORTHOGONAL INTERFEROMETRY PROJECTILE FLIGHT MANAGEMENT TO TERMINAL GUIDANCE WITH ELECTRO-OPTICAL HANDOFF

CROSS REFERENCE TO RELATED APPLICATIONS

This application claims the benefit of U.S. Provisional Pat. Application No. 62/738,016, filed Sep. 28, 2018, and U.S. Provisional Pat. Application No. 62/738,082, filed Sep. 28, 2018, the content of which is incorporated by reference herein its entirety.

FIELD OF THE DISCLOSURE

The present disclosure generally relates to accurately guiding projectiles and more particularly to guiding projectiles in GPS-denied or GPS-limited environments using at least partially radio frequency (RF) / orthogonal interferometry (OI) techniques.

BACKGROUND

The dominant approach currently used for guiding a weapon, projectile, UAV, or other similar asset is the global positioning system (GPS). The weapon, projectile, UAV, or the like measures its earth position in latitude, longitude, and altitude, to calculate and execute a trajectory towards a GPS located target. This approach has been in use for many years but is now becoming vulnerable to GPS jamming, both denied and spoofing. Other techniques to extend the GPS approach involve pseudolites, or pseudo-satellites, which are devices that are placed along the path to the target and which utilizes GPS-like transmissions to aid the navigation of the asset. One issue with this approach is the delivery/placement of the pseudolites along the path to the target. The risk to the installer is high given these pseudolites are typically in hostile regions and they are also susceptible to jamming since they are analogous to systems using GPS waveforms. Other pseudolite deployments utilize air platforms, which complicate the engagement logistically.

Wherefore it is an object of the present disclosure to overcome the above-mentioned shortcomings and drawbacks associated with conventional projectile guidance systems especially in GPS-denied and GPS-limited environments.

SUMMARY

It has been recognized that there is a need to replace or supplement GPS navigation with an improved guidance system for success in today's tactical environment. One aspect of the present disclosure is a navigation method within a GPS-denied or a GPS-limited environment that utilizes a local domain RF illuminator for projectile, such as a guided munition, artillery round, mortar, rail gun projectile, UAV, or other asset guidance that can be deployed away from an engagement area, whether ground, air or maritime based. In certain embodiments, the RF system provides GPS navigation-like performance, but is resistant to jamming, spoofing and the like.

A combined navigation system directing at least one projectile toward at least one target, comprising: a radio frequency orthogonal interferometry array providing a reference frame, projected in the direction of a target area having radio frequency orthogonal interferometry waveforms and to further provide radio frequency (RF) communications, wherein the reference frame establishes a top boundary and a bottom boundary; at least one projectile configured to receive the radio frequency orthogonal interferometry waveforms and at least one of range information and mission information; a short range guidance system on the projectile configured to provide guidance of the projectile from a hand-off point to the target area, wherein the hand-off point is at a time before the target reaches the bottom boundary of the reference frame; and a non-transitory computer-readable storage medium carried by the projectile having a set of instructions encoded thereon that when executed by one or more processors, provide guidance and navigation of the projectile, the set of instructions being configured to perform: processing azimuth and elevation information from the radio frequency orthogonal interferometry waveforms; processing the at least one of range information and mission information from the RF communications; determining coordinates of the projectile using the azimuth, elevation and range information, wherein the coordinates are relative to the radio frequency orthogonal interferometry array; guiding the projectile along a trajectory within the reference frame to the hand-off point; switching to the short range guidance system at the hand-off point; and guiding the projectile from the hand-off point to the target area using the short range guidance system.

A further embodiment provides a projectile, comprising: an antenna on the projectile wherein the projectile has a front portion and a rear portion and the antenna is oriented to be rear facing; a radio frequency (RF) receiver coupled to the antenna and configured to receive radio frequency orthogonal interferometry waveforms and RF communications; a guidance, navigation and control section processing the radio frequency orthogonal interferometry waveforms and RF communications to determine coordinates of the projectile and generate guidance instructions; a control actuation system executing the guidance instruction; an electro-optical terminal guidance system configured to provide guidance of the projectile from a hand-off point to a target area; and a warhead having a fuze that detonates the warhead proximate the target.

Yet another aspect of the present disclosure is a focused fire system directing a plurality of air-borne devices toward at least one target, comprising: a radio frequency orthogonal interferometry array providing a reference frame, via a projected grid, in the direction of the at least one target; the reference frame providing azimuth and elevation information for use in guidance of the plurality of air-borne devices from a distance from the at least one target to a hand-off pointy; and a terminal guidance system configured to accept a hand-off from the radio frequency orthogonal interferometry array and begin guidance of the plurality of air-borne devices from the hand-off point to the at least one target.

One embodiment of the focused fire system directing a plurality of air-borne devices toward at least one target is wherein the radio frequency orthogonal interferometry array is aligned via a north finding device. In some embodiments, the distance from the target is about 100 km and the hand-off point is less than about 10 km.

Another embodiment of the focused fire system directing a plurality of air-borne devices toward at least one target is wherein the terminal guidance system is a semi-active laser seeker and each of the plurality of air-borne devices is sequentially handed off from the reference frame to the terminal guidance system as a cascade of events.

Yet another embodiment of the focused fire system directing a plurality of air-borne devices toward at least one target is wherein the terminal guidance system is a semi-active laser seeker and each of the plurality of air-borne devices is sequentially launched such that each of the plurality of air-borne devices may also be sequentially handed off from the reference frame to the terminal guidance system for controlled detonation of a single target.

Still yet another aspect of the present disclosure is a method of guiding at least one air-borne device toward at least one target, comprising: initiating a fire command via a fire control system; loading and firing at least one air-borne device; receiving, via a communication link, target information and waveform mission code information at the at least one air-borne device; determining azimuth, elevation, and range to target information for each of the at least one air-borne devices, via a radio frequency orthogonal interferometry array; calculating target navigation way-points via each of the at least one air-borne devices; determining a hand-off point where terminal guidance begins; and navigating each of the at least one air-borne devices to the at least one target.

These aspects of the disclosure are not meant to be exclusive and other features, aspects, and advantages of the present disclosure will be readily apparent to those of ordinary skill in the art when read in conjunction with the following description, appended claims, and accompanying drawings.

BRIEF DESCRIPTION OF THE DRAWINGS

The foregoing and other objects, features, and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure.

FIG. 2E shows a zoomed in view of the product of the real beam pattern and electrically large interferometric ambiguity of FIG. 2D.

DETAILED DESCRIPTION

In one embodiment of the system of the present disclosure, a Radio Frequency (RF) / Orthogonal Interferometry (also referred to as Orthogonal Interferometer) (OI) illuminator or transmitter is located at some position from the weapon system (e.g., at 0 to 100 km) and an RF receiver is mounted on an asset and receives the OI waveforms (distinguishable waveforms referenced to respective phase centers) to determine azimuth and elevation and to receive range information from an RF communications link in order to guide the asset to a target. In some embodiments, the azimuth and elevation information has an accuracy of about 100 to 300 μrads depending on the transmitter configuration. In some cases, the system range information has an accuracy of about +/- 20 to 40 meters depending on various system operating parameters. In certain embodiments, the asset is given the target's location prior to launch or via RF or other communications link after launch within the RF/OI frame of reference. The asset in one example has on-board processing capability and calculates the trajectory for the target intercept using on-board guidance laws on and on-board processor.

The approach to local domain guidance control of the present disclosure allows the user to deploy an RF/OI illumination system anywhere in the world given the portability of the system (e.g., it fits on a small utility trailer), the system's range > 100 km, and the system's accuracy. This system's performance is similar in some respects to the GPS systems, but has the added benefit of jam resistance due to features such as the use of custom coding of the RF/OI waveform, the illuminator's signal strength, the deployment geometry, and the antenna configurations. Unlike the GPS navigation waveforms which are published, the RF/OI illumination system would not be public. The system operator could select frequency, Pulse Repetition Interval (PRI) and pulse duration, and other parameters. For example, the control of the waveform properties including pulse width, frequency and/or frequency hopping are used by the illuminator to mitigate jamming. Assuming a 100 nanosecond pulse, frequency hopping with varying PRI could be utilized in a code format loaded prior to launch or during flight. In addition, the rearward looking antenna on the projectile provides receiver isolation from any jammers forward or below the projectile. The combination waveform control and antenna spatial selectivity provides counter measure immunity or mitigation. The RF/OI illumination system is also difficult to detect. As an example, ground based jammers have the additional burden of being direct line of sight of the RF/OI illuminator, thereby making detecting its presence difficult due to the curvature of the earth.

Figure 1A:
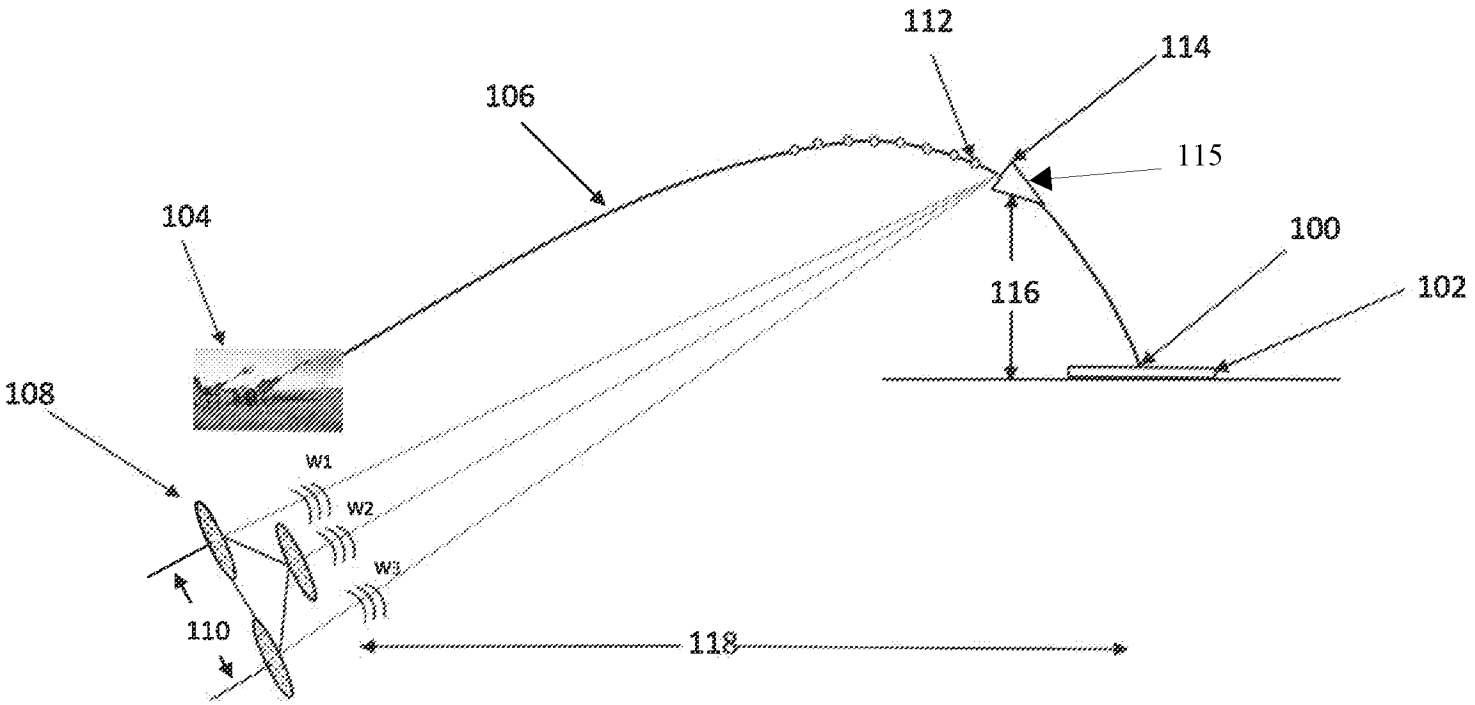
FIG. 1A is a diagram of one embodiment of the system of the present disclosure.

Referring to FIG. 1A, a diagram of one embodiment of the system of the present disclosure is shown. More specifically, at least one asset 115 is launched from a launch area 104 and the at least one asset 115 is directed at a target 100 some distance away 118 from the launch area 104. In some cases, the distance 118 is about 200 km. After launch, the asset 115 (e.g., munition, projectile, etc.) travels along a trajectory 106 toward the target 100. A circular error probable (CEP-50) 102 is defined as a circular area having a radius that encompasses where 50% of the assets land. CEP-50 is a common measure of accuracy for ballistics. In certain embodiments of the system of the present disclosure, the CEP-50 102 is about 30 m. In some cases, the CEP-50 102 is limited by the performance of the air frame, its limited control authority, the asset's ability to perform high G maneuvers, and the like.

Still referring to FIG. 1A, a radio frequency (RF) / Orthogonal Interferometry (OI) illuminator 108 is used to guide the one or more assets to the target. In one embodiment, the RF array comprises three active electronically scanned array (AESA) panels 109, where an AESA is one type of phased array antenna that is computer-controlled. There, the RF waves may be electronically steered to point in different directions without physically moving the antenna such as by leveraging the many antenna elements in the array.

In some embodiments of the system of the present disclosure, the array panels can also move. In one embodiment, the RF array is compact, with dimensions 110 of about 1.5 m × 1.5 m × 0.75 m. The AESA panels 109 are typically located proximate each other with some separation. The number of panels can vary depending upon the desired accuracy and redundancy.

In some embodiments, the RF array 108 guides (and tracks if equipped with fire control system) the one or more assets 115 along the trajectory 106 with accuracy of about ±5 m range and ±10 m azimuth and elevation 112. In certain embodiments, the RF array uses orthogonal interferometry (OI) methods to project a reference frame, or a projected grid, which is analogous to a polar coordinate azimuth and elevation for the three dimensional space. The polar coordinates can be can be mapped to standard grid coordinates - latitude and longitude. In one example, the RF/OI illuminator system 108 produces a reference frame that is aligned using a north finding device such as a gyro, or the like, such that the one or more projectiles or assets 115 do not require separate north finding capabilities. In this case a single north finding device can be leveraged for multiple assets such as a swarm. The north finding device is intended to obtain a reference point for the further processing. This also tempers the need for precise alignment of the assets -center mass aiming - and thus, minimizes operator processing time and resources. In certain embodiments, the RF/OI system can provide 10°, 20°, or 30° fields of engagement. In some embodiments, the system provides for adjustable accuracy/guidance precision based, in part, on the RF/OI transmit power, antenna spacing, and deployment angle, where the cross range accuracy is equal to angular resolution times range. Thus the present system operates in GPS denied environments with minimal likelihood of being jammed or spoofed.

Additionally, the system of the present disclosure provides a means to precisely measure and subsequently correct trajectory variations due to the varying energetics and the cross wind impact of each of the one or more projectiles by maintaining the desired trajectory using the RF/OI system array as a stable and precise frame of reference for long range position and projectile guidance. This technique reduces the complexity and the cost of the control actuator system (CAS) by simplifying the components needed on the projectiles. The control actuation system in one example provide fins or canards with controllers that enable changes to the flight of the asset. In some cases, an RF receiver and RF apertures are present on each round. In some cases, by using the RF/OI system, no azimuth aiming is required and minimal elevation adjustment is needed for each projectile, thus allowing the flight navigation system to make the course corrections accounting for the range differential due to energetics and aiming errors. The projectile in one example is a small rocket or artillery round having a warhead, a fuse, a control actuation system, guidance and navigation system, and a rocket engine. The guidance and navigation section in one embodiment includes a rear facing antenna/aperture, RF receiver, control actuation system, and a short range guidance system. The short range guidance system detector can include at least one detector such as a semi-active laser seeker or imaging system. Alternatively, the short range guidance system can be an inertial measurement unit that provides orientation and enables the asset to continue its trajectory to the target.

In one embodiment of the system of the present disclosure, the RF/OI system 108 "hands off" the positioning and guidance of the one or more projectiles at a certain hand-off point 114. Hand-off refers to a transition point from the use of the RF/OI guidance to a secondary form of guidance, to increase the accuracy of the projectile. In some cases, the hand-off point 114 is about 6 km to about 10 km from the target 100 along the flight path. In some cases, the hand-off point 114 is located a distance above a plane 116 within which the target is located. In some cases the distance 116 is about two km to about three km above the plane. In some cases, the target is on land. In some other cases the target is on the surface of water. The hand-off can be accomplished as a timed event starting from launch or the hand-off can be event driven. In certain embodiments, an event driven hand-off may be when a short range guidance system (e.g., a semi-active laser or image seeker) detects the target and initiates terminal guidance.

The navigation approach of the present disclosure can be adapted for airborne assets, such as a UAV, and would use a tracking subsystem on the ground providing target location updates to the UAV. The RF receiver on the UAV can determine the relative azimuth and elevation coordinates from the illumination system. The RF uplink can be coded to determine range via a range tracking filter in conjunction with a time synchronization scheme. The information is processed and translates the polar coordinates, azimuth, elevation and range to grid (e.g., latitude and longitude) given the orientation of the illumination relative to latitude, longitude coordinates.

In certain embodiments, the hand-off is from the RF/OI array to a semi-active laser (SAL) seeker. In some cases, each of the one or more projectiles has a unique SAL hand-off associated with it such as the operating range and based on the distance to the target. In certain cases, the hand-off error is less than 0.1 degree. In some embodiments of the present disclosure, a SAL seeker is located on the front or midsection of the asset and the asset is guided by a designator (laser) coming from a forward observer on the ground, a UAV, or an aircraft. The use of coding technology in the SAL seeker mitigates false locks onto a second target where multiple designators are in the same engagement space or counter countermeasures (CCM) are being employed to defeat the weapon's accuracy. In some cases, the SAL seeker is capable of detection at 10 km with 1 mrad target angle error. In some embodiments, the SAL seeker has a field of view (FOV) ranging from about 40 to about 70 degrees.

While the present system provides operation in a GPS denied environment, in one example the asset includes a GPS receiver and can use the information from the GPS to enhance the targeting information. In a further example, the processing information form the RF/OI system detailed herein is utilized to confirm that the GPS data is accurate and not being spoofed. In one example, if the targeting data between the GPS and the RF/OI diverge beyond an acceptable amount, the system will disregard the GPS data and rely upon the RF/OI for targeting.

In other embodiments, the hand-off is to a low cost internal measurement unit (IMU) instead of the SAL seeker and this is used in the last stage prior to detonation. In one example the last stage is about 4-5 seconds. In some cases, IMU precision can be improved by determining the drift as compared to the RF receiver. The lower cost IMU can be calibrated during flight and thereby provides a higher level of performance when the RF/OI processing is no longer available such as due to line of sight issues.

In certain embodiments, the system is utilized for the deployed delivery of several or many artillery rounds in a grid pattern for area effects. The intent of the grid pattern is to uniformly cover an engagement area where the distance between round locations is more useful than the absolute placement of the group as a whole. In this manner, the grid pattern can be processed to indicate the number of rounds required for a certain level of impact and coverage of a region. In certain embodiments, the RF/OI illuminator provides sufficient guidance control up to the point where LOS hinders the RF/OI transmission and the artillery round trims and glides the ballistic toward the target. The guidance prior to loss of the RF/OI signals mitigates errors due to launch velocity, aiming error, and the majority of cross wind effects. Given the weight of the artillery round, very little error will be realized even when guidance is ended at two to four km above a target.

In still other embodiments, the hand-off is to an image-based homing and navigation system. In certain embodiments, a library of images exists for a given target area. The library is available to the one or more assets for guidance purposes and when one or more images in the library are matched to images from the field of view of the asset, once the asset is within a certain distance, the asset munition may be detonated. In some cases, automatic target recognition (ATR) is used. Generally, image-based methods are more effective for fixed targets, such as buildings, and the like. Wind and the energetics of launch can affect the trajectory of a munition but the RF/OI system, provides a precise positioning capability to the RF receiver, and is used, in part, to keep the correct steering for the munition until a short range guidance system takes over.

Figure 1B:
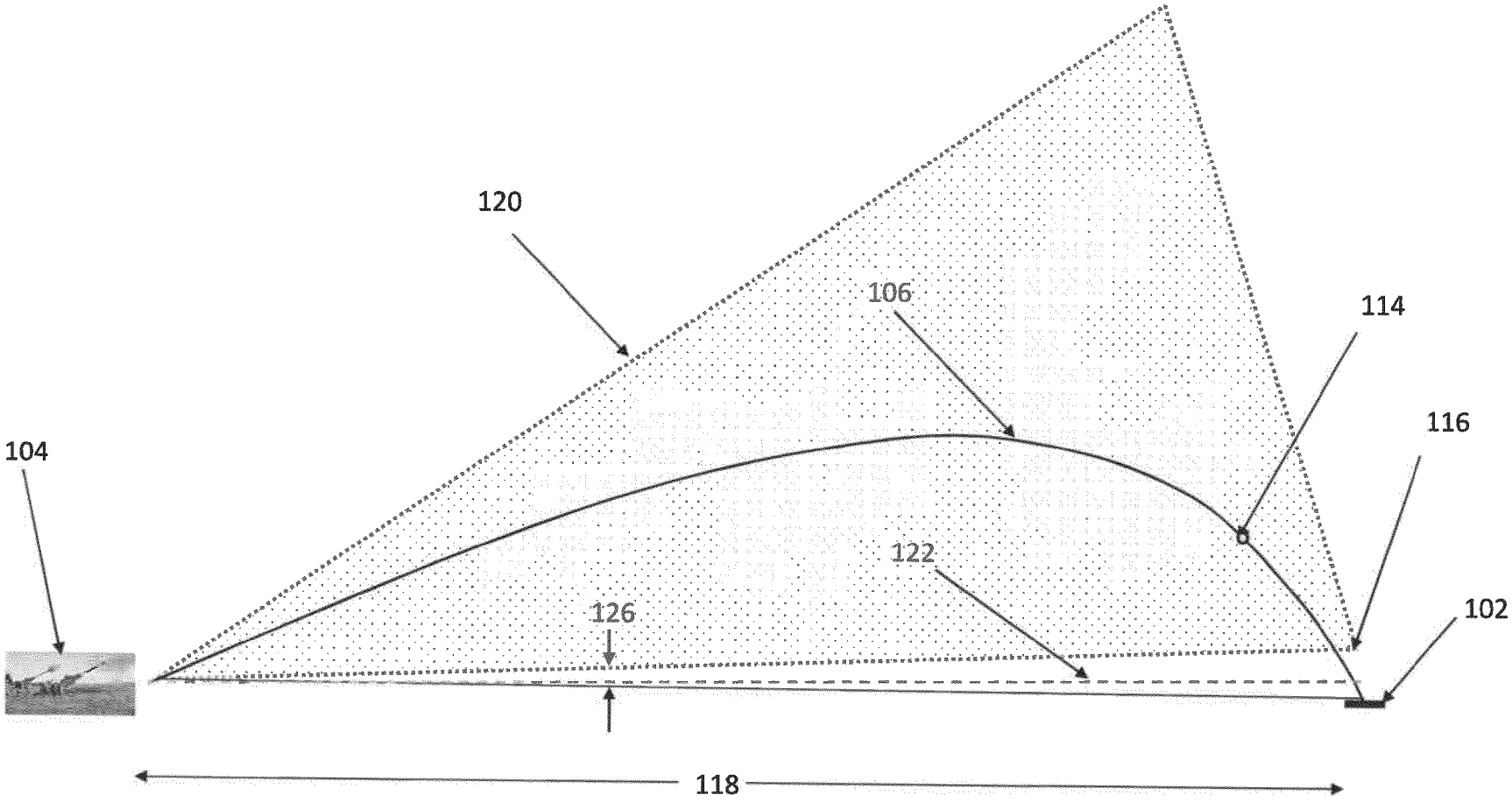
FIG. 1B is a diagram of one embodiment of the system of the present disclosure.

FIG. 1B depicts a diagram of one embodiment of the system of the present disclosure. More specifically, in this figure the RF/OI system is co-located with the launch point 104 for the one or more assets or projectiles (only one flight path is shown). In some cases, the RF/OI system is located well behind the launch point to provide protection for the RF/OI array. In some cases, the RF/OI system can be located a distance 118 from the target having a known CEP-50 102. In certain embodiments, the distance 118 is about 100 km and the CEP-50 is about 30 m. In contrast, a conventional radar system has range limitations for two-way radar, and may need to be forward deployed, thus placing the radar system in front of the launch area endangering the equipment by subjecting it to crossfire and or direct targeting by enemy forces.

As seen in FIG. 1B, the RF/OI system produces a RF reference frame 120. The munition trajectory 106 is located within that reference frame 120. The reference frame 120 does not require active scanning and thus provides for simplified flight control management. The reference frame 120 also provides for tracking of multiple rounds or projectiles at the same time by essentially projecting a grid in the air as a reference frame. The hand-off point 114, e.g., where a SAL seeker or IMU takes over the short range tracking and guidance for the one or more projectiles, is also shown and is also within the reference frame. In certain embodiments, RF communication links on each asset allows for programming the trajectory during flight for each asset, including, for example SAL codes. In some cases, the guidance for the asset begins at the moment of firing or early in the flight trajectory. With the present system, no pre-firing program or precise aiming of the weapon system is needed. Instead, guidance can be handled directly from a mission computer.

Still referring to FIG. 1B, the line of sight (LOS) 122 is limited over the distance 118 due to the curvature of the earth. In one embodiment, the distance above the plane of the target 116 for the LOS is about 800 m. In certain embodiments, the distance above the plane of the target 116 for the base of the RF reference frame is about 1400 m, thus making the hand-off point 114 at which terminal guidance is handled by a SAL seeker, or the like, very important for high accuracy in targeting. In some cases, a magnetometer inertial measurement unit (IMU) is used to supplement the guidance of the one or more projectiles or assets. Thus the hand-off point 114 needs to be located above the plane of the target 116. The maximum hand-off point is at the boundaries of the reference frame 120 after which the asset would not be able to obtain any further data from the illuminator.

The lack of LOS prevents the asset from seeing the RF/OI illuminator 108 below the horizon. In addition, the RF/OI receiver's waveform is controlled to mitigate multipath due to the earth and influencing the accuracy of the position measurement. Waveforms allow multipath mitigation and allow the receiver to post process the impact of multipath out of the position results. These techniques yield a safe zone of navigation that corresponds in one example to a slant angle of about 1 degree 90 from the RF/OI illuminator or a height restriction 116 which is range dependent.

Figure 2B:
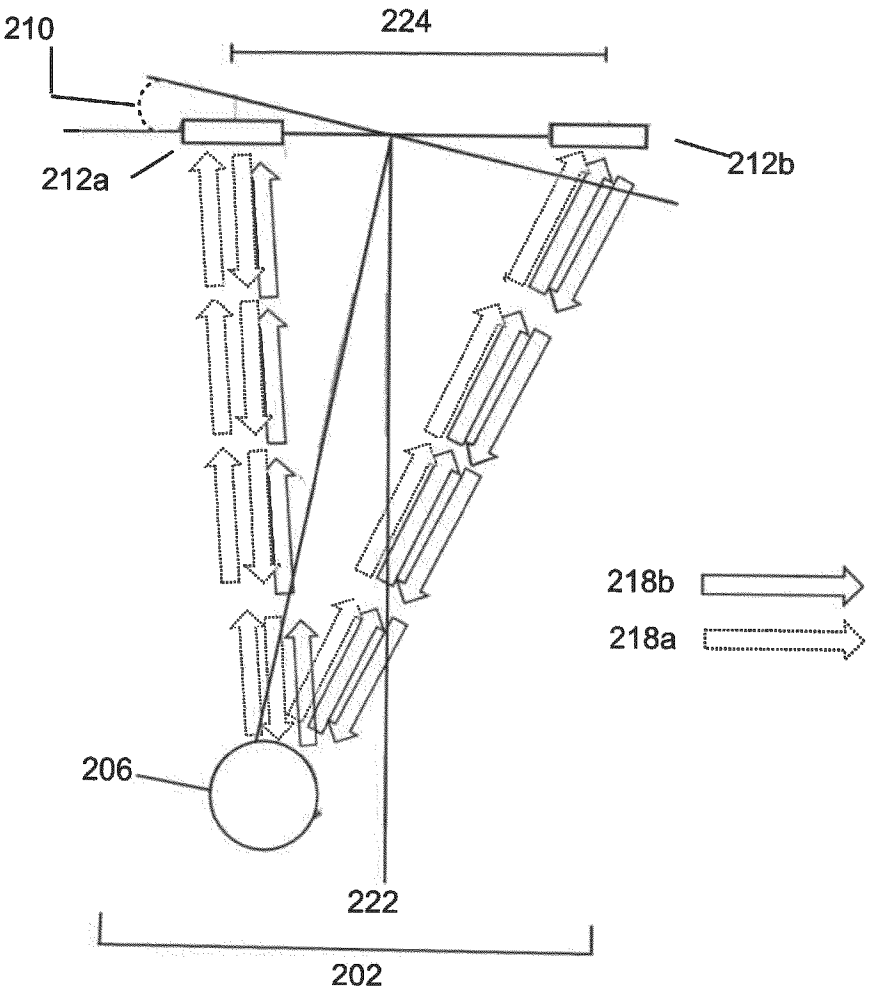
FIG. 2B is an orthogonal interferometer (OI) according to the principles of the present disclosure.
Figure 2A:
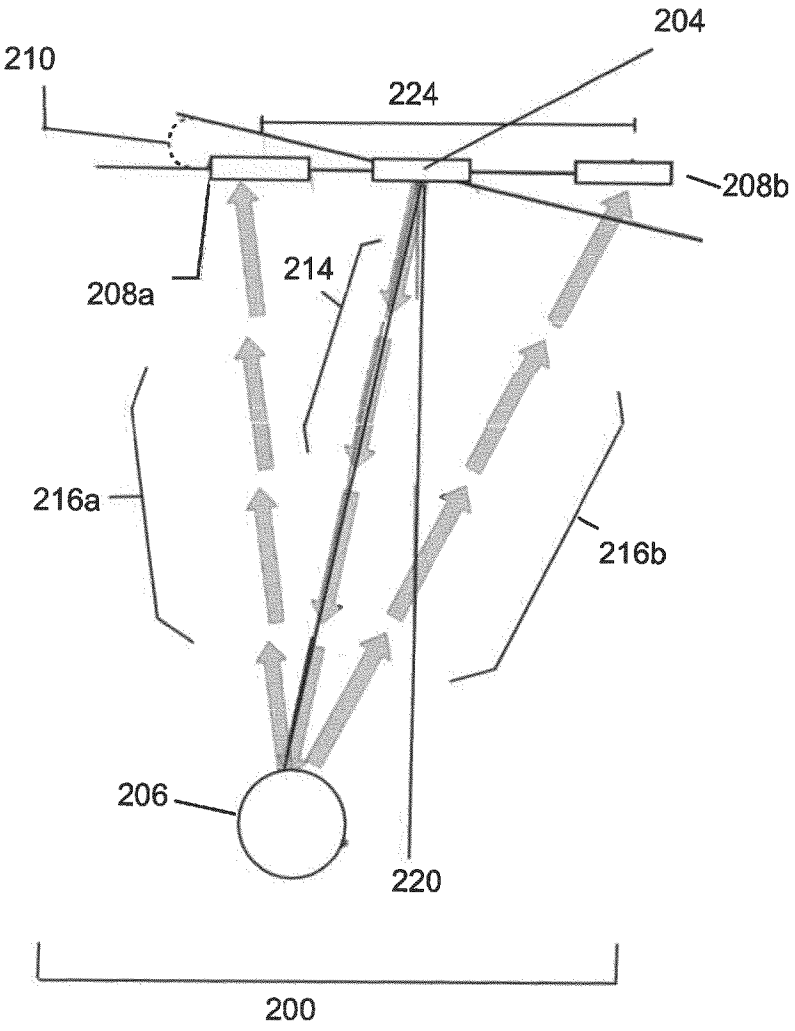
FIG. 2A is a conventional interferometer (CI) according to the principles of the present disclosure.

FIG. 2A and FIG. 2B compare simulations of the path lengths and system components of a conventional interferometer (CI) 200 and an Orthogonal Interferometer (OI) 202 for a notional two dimensional case. For a CI measurement, a transmitter 204 illuminates the target 206 and the phase of the returns at two separate receivers 208*a*, 208*b* provides a differential path length difference ($\Delta\phi$) that leads to a target angle estimate of $\theta$ 210. In the case of OI 202, two phase centers 212*a*, 212*b* each transmit orthogonal transmissions which are individually decorrelated on respective receptions. The fundamental concept behind the orthogonal interferometer is the use of at least two coherent transmit/receive antennas 212*a*, 212*b* that transmit nearly orthogonal coded waveforms. For example the orthogonal transmission from 212*a* travels to target 206 and returns to both transmit/receive antennas 212*a*, and 212*b*, this is shown by path 218*b*. Additionally an orthogonal transmission from 212*b* travels to target 206 and returns to both 212*a* and 212*b*, shown by path 218*b*. On reception, the separation of the signals is achieved by decoding against a particular code and exploiting the cross-correlation suppression of the orthogonal coded waveforms. Orthogonal coding in this sense can entail some combination of time, frequency and/or code modulation- as long as the receiver can perform a decorrelation and form an estimate of the received signal keyed to a particular transmit phase center.

As depicted the CI 200 case has a common transmit 214 and distinct receive paths 216*a*, 216*b* while the OI 202 case has distinct transmit and receive paths 218*a*, 218*b* at each receiver 212*a*, 212*b*. Decoding OI has achieved a double path length dependency which provides twice the target angle 210 sensitivity as compared to CI with an equivalent SNR. The phase difference relationship of an interferometry is defined as $$\Delta\phi = K_\phi \frac{D}{2\pi\lambda}\sin(\theta); K_\phi = 1(CI), 2(OI)$$

where D is the interferometer baseline (array phase center separation) 224, λ is the nominal operating wavelength), and $K_\phi$ represents the phase gain factor that depends on path length. This expression highlights the physical advantage of a system with an electrically large baseline $$\left(\frac{D}{\lambda}\right)$$

in that it yields a greater Δϕ for the same target offset θ; the geometric "gain" of the larger interferometric baseline yields a larger Δϕ relative to SNR dependent phase estimation noise $\sigma^2_{\Delta\phi}$ and provides a more precise measurement of θ. In many signal processing applications the localized performance of an estimator can be bounded by the Cramer-Rao Lower Bound (CRLB). This bound on the θ estimation error for a CI radar or an OI radar is $$\sigma_\theta^{CI,OI} = \frac{\lambda}{K_\phi 2\pi D\sqrt{SNR}}; K_\phi = 1(CI), 2(OI)$$

Note that for the same interferometer baseline (D) and same SNR the OI angle accuracy is a factor of two better than the CI angle accuracy.

Figure 2C:
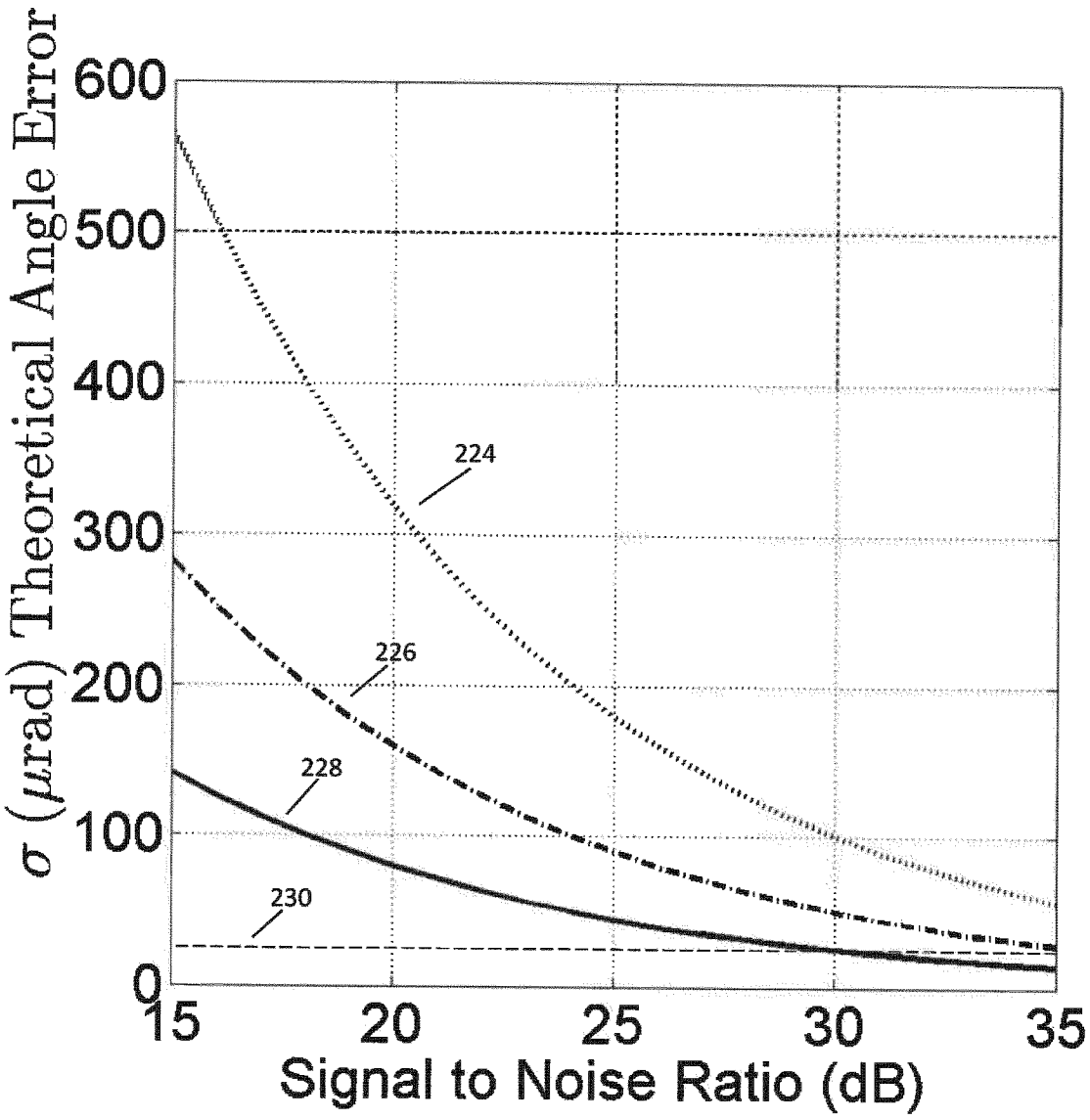
FIG. 2C shows the reduction in angle error with an OI compared to a CI with equivalent signal-to-noise ratio (SNR) according to the principles of the present disclosure.

FIG. 2C depicts the reduction in angle error with an OI compared to the CI with equivalent SNR; the OI radar achieves twice the precision (or the effective baseline) as compared to the CI radar. FIG. 2C compares CI case, D = 50λ, 224 with two OI cases D = 50λ 226, D = 100λ 228 against with the ambitious angular precision goal $\sigma_\theta$ = 25μrad 230. It should also be noted that with respect to precision, a factor of two improvement in λ/D is worth a factor of four improvement in SNR.

This increase in the local precision of the angular estimate of θ due to an increased $$\frac{D}{\lambda}$$

comes at the cost of an increased chance of an ambiguous θ estimate. Angle ambiguity is a fundamental tradeoff that must be resolved for the potential of this increased estimator precision to have a real world benefit. There are a range of techniques used to suppress interferometer ambiguity. Depending on the particular application a combination of these techniques (discussed briefly herein) can provide effective angle disambiguation.

For interferometer baselines with D » λ, Δϕ can greatly exceed 2π so the determination of angle-of-arrival using phase difference $$\sin(\theta) = \frac{\lambda\Delta\phi}{4\pi D} + 2\pi N$$

will be ambiguous by N 2π wraps where N is the ambiguity number.

Figure 2D:
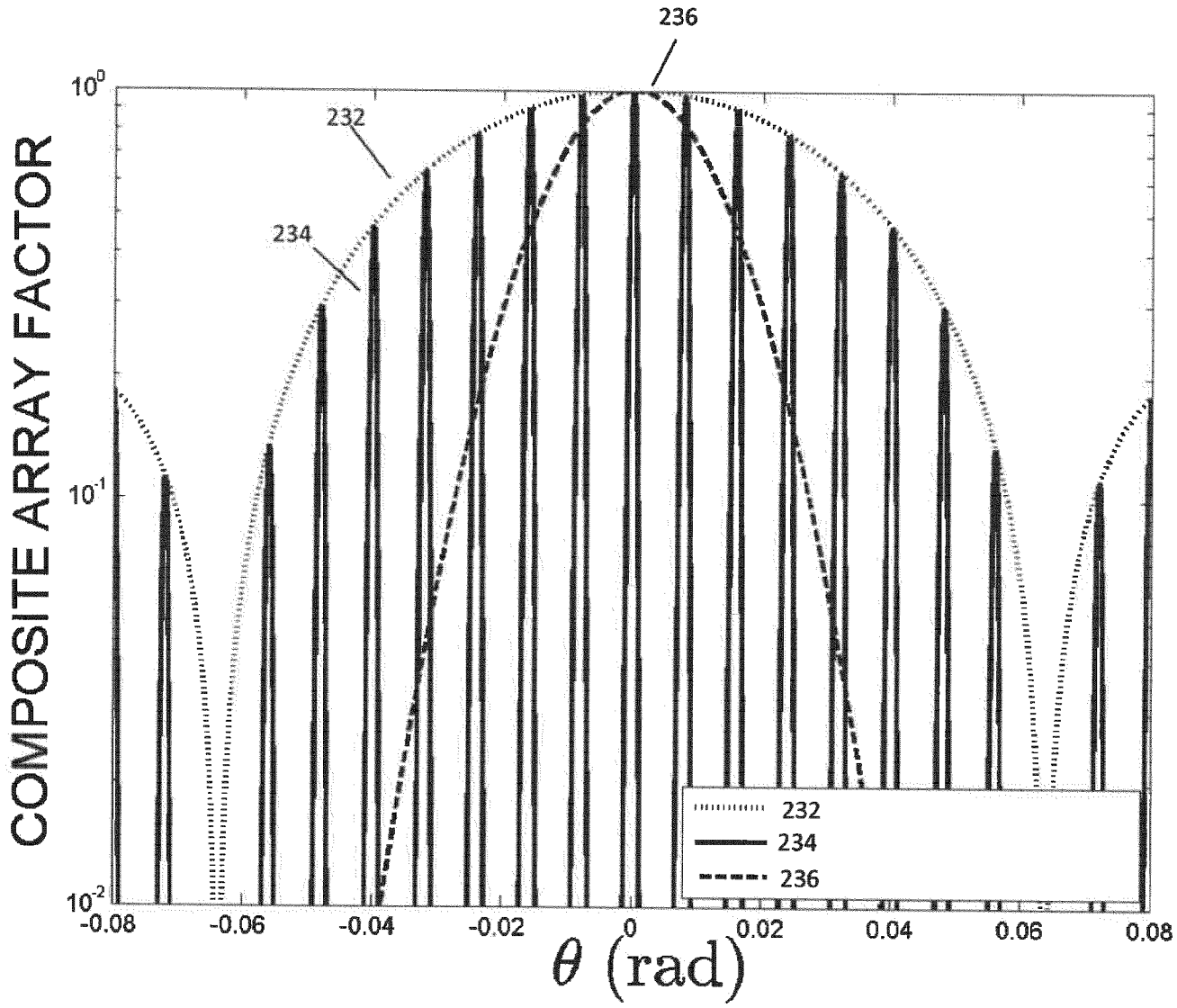
FIG. 2D shows a typical product of a real beam pattern and an electrically large interferometric ambiguity according to the principles of the present disclosure.

FIG. 2D and FIG. 2E depict a typical product of a beam pattern 232 and an electrically large interferometric ambiguity 234. Note that there are many closely spaced $$\frac{\lambda}{D}$$

lobes within the main lobe - all reflecting the same Δϕ (modulo 2π measurement). Two important points should be taken from the "zoom" portion in FIG. 2E: First, $$\sigma_\theta^{CI,OI}$$

, the angular precision of a local radius of a $$\frac{\lambda}{D}$$

lobe 234 trace is much finer than the physical beam pattern. Trying to disambiguate these closely spaced lobes based on a model of the amplitude difference from the main lobe's much broader response will require very high SNR and a highly consistent signal model that is unlikely to be available in a tactical systems.

Still referring to FIG. 2D, The 236 trace represents a prior probability that would be part of a recursive tracking filter. CRLB is the radius of the local lobe. Trace 232 represents the array beam pattern and trace 234 represents the interferometer lobes. The figure shows large interferometer baselines D=100λ gain precision with increased ambiguity.

Another approach to ambiguity mitigation for the OI-tracer application would exploit the high prior information on the projectile trajectory, which provides the opportunity to incorporate accurate kinematic models. In this case, the 236 trace can be interpreted as a prior estimate in a non-linear estimation/tracking formulation where a specific $$\frac{\lambda}{D}$$

lobe's probability is updated via a Bayesian recursion and the local covariance is update via a Kalman Filter. A physical example of exploiting prior information would involve an OI radar with $$\frac{\lambda}{D} = \frac{1}{100}$$

or 1 meter at 100 m range which is still extremely coarse as compared to the "close-in" CEP of the projectile.

For a projectile guidance application, where all the projectiles are cooperative, and there are well timed targets, this approach would be naturally integrated into a tracking filter that can be incorporated the aero-ballistic modeling. A final approach to ambiguity suppression involves multiple measurements at distinct λ/D values forming multiple interferometric baselines. For each available λ/D baseline, the relationship among feasible ambiguity numbers scales (by λ/D) but since the true target angle θ is independent of $$\frac{\lambda}{D}$$

the unwrapped $0^{th}$ lobe experiences no shift.

Figure 2F:
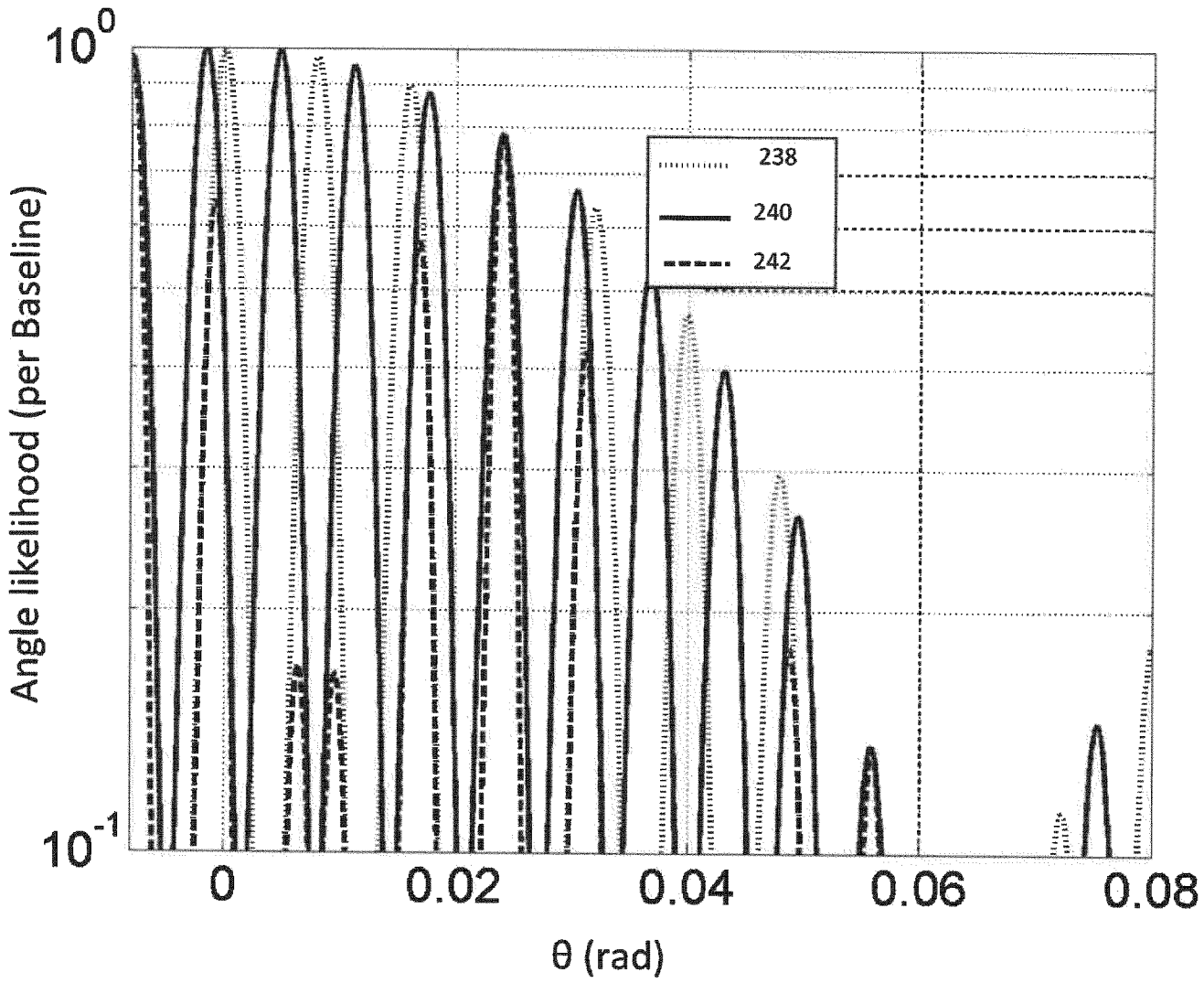
FIG. 2F shows the interaction of two lobe spacings whose product yields a substantial reduction in lobe amplitude according to the principles of the present disclosure.

FIG. 2F depicts (for θ = 0) the interaction of two lobe spacings whose product yields a substantial reduction in lobe amplitude. Ambiguity can be suppressed by combining different $$\frac{\lambda}{D}$$

measurements.

$$\sin(\theta)=\frac{\lambda_1\Delta\phi_1}{4\pi D_1}+2\pi N_1 \text{ and } \sin(\theta)=\frac{\lambda_1\Delta\phi_2}{4\pi D_2}+2\pi N_2$$

This lobe-wise product will only admit an θ ambiguity where the two lobe spaces overlap closely; in the combination of $$\frac{\lambda}{D}=\frac{1}{125}$$

238 and of $$\frac{\lambda}{D}=\frac{1}{100}$$

240 or the 125/100 case, the first significant overlap 242 occurs at the $5^{th}$ $$\frac{\lambda}{D}=\frac{1}{125}$$

lobe and the $4^{th}$ $$\frac{\lambda}{D}=\frac{1}{100}$$

lobe. Hence, there is another ambiguity suppression approach that involves the projectile priors and the interferometer design. In sum, achieving very high precision angle and trajectory estimates via large baseline interferometry incurs some additional complexity of angle ambiguity. Successful mitigation of the ambiguity challenge in an operational system requires integration of the interferometer, array, and aero-ballistic modeling — the details each depending on the particular system configuration under consideration.

In certain embodiments of the system of the present disclosure, the RF system via an orthogonal interferometry (OI) reference frame operates at a frequency of about 5-10 GHz and has a signal-to-noise ratio (SNR) of about 20 dB. In some embodiments, the antenna gain is about 15 - 20 dB. In some cases, the baseline is about 1.5 m with an angular precision of less than 1 mrad. In some cases, the angular accuracy is about 0.45 mrad. This accuracy is in contrast to conventional radar systems that have angular accuracy of about one to two degrees. Conventional radar systems are also limited by bandwidth. Additionally, radar has cross range resolution at 100 km of about 2.5 km (1.5° beam width) as compared to a 45 m cross range resolution for the RF/OI system disclosed herein. At 50 km, the present system has 22 m accuracy (based on resolution only and all other errors nulled). The radar inaccuracy uses the SAL seeker, IMU, or imaging system at the end of the asset trajectory to correct the large cross range error — 2.5 km. In the IO case the cross range error is about 45 meters, which is somewhat large for a desired CEP 30 meters, but is relatively close, and a more accurate OI illuminator can be used to drive error down further by raising bandwidth for the data stream to 200 Hz and averaging it down to half the error. This accuracy provides for accurate hand-off positioning. In certain embodiments, by increasing the bandwidth of the data stream to 200 Hz, the averaging can increase the overall accuracy by 2 to 3x, thereby negating the need for a terminal seeker and meeting respectable CEP of 30 meters. The present system provides actual location within GPS norms. In contrast, conventional radar systems produce a beam that is too broad to implement an angle transfer as described herein.

In some cases, the power requirement for the system ranges from about 100-200 W. The power needed is much lower than for a conventional radar system (e.g. 100 kW). Additionally, the RF/OI system is preferred due to inherent jamming resistance as compared to radar systems. In some embodiments, the projectiles have rear looking antennas for use with the RF/OI system. In some cases, the RF/OI illuminator can control multiple weapon batteries or UAV against multiple targets. The RF/OI reference frame is analogous to the localized GPS where several weapons platforms, air vehicles, and weapons can use the same RF/OI reference frame for navigation. In some cases, the coded pulse series for the system of the present disclosure is about 1.7 μsec which encapsulates the RF/OI waveform. The pulse waveform can be coded for simple operation where the issue of multipath is minimal (ground to air or air to ground scenarios) or heavily reliant on bandwidth/frequency diversity to process out the impact of multipath (ground to ground engagements).

The RF/OI illuminator generates a reference frame analogous to GPS in a local domain or engagement. The system can be deployed aligned to latitude and longitude coordinates by orienting the system to earth's latitude/longitude grid or as a completely independent reference system. In all cases the RF/OI illuminates the reference frame where the flight vehicles determine the azimuth and elevation position relative to the RF/OI illuminator (aligned to the earth or not) and the RF communications link via range tracking filter determines the third component (range) of a polar coordinate system. The polar coordinate system in one example is an earth coordinate system by orienting the illuminator to an earth latitude/longitude grid. In another example, the asset operates in the polar coordinate system relative to the illuminator and receives earth coordinate information from the RF communications link that allow the asset to convert to the earth coordinate system.

In certain embodiments, the illuminator is a wide field of view (FOV) system that provides for all assets with the same signal. The RF communications link provides the unique information for each asset. Information could include, orientation to earth's coordinate's, target's location, target type, waypoints for the vehicle flight path, fusing parameters, and the like.

Figure 3:
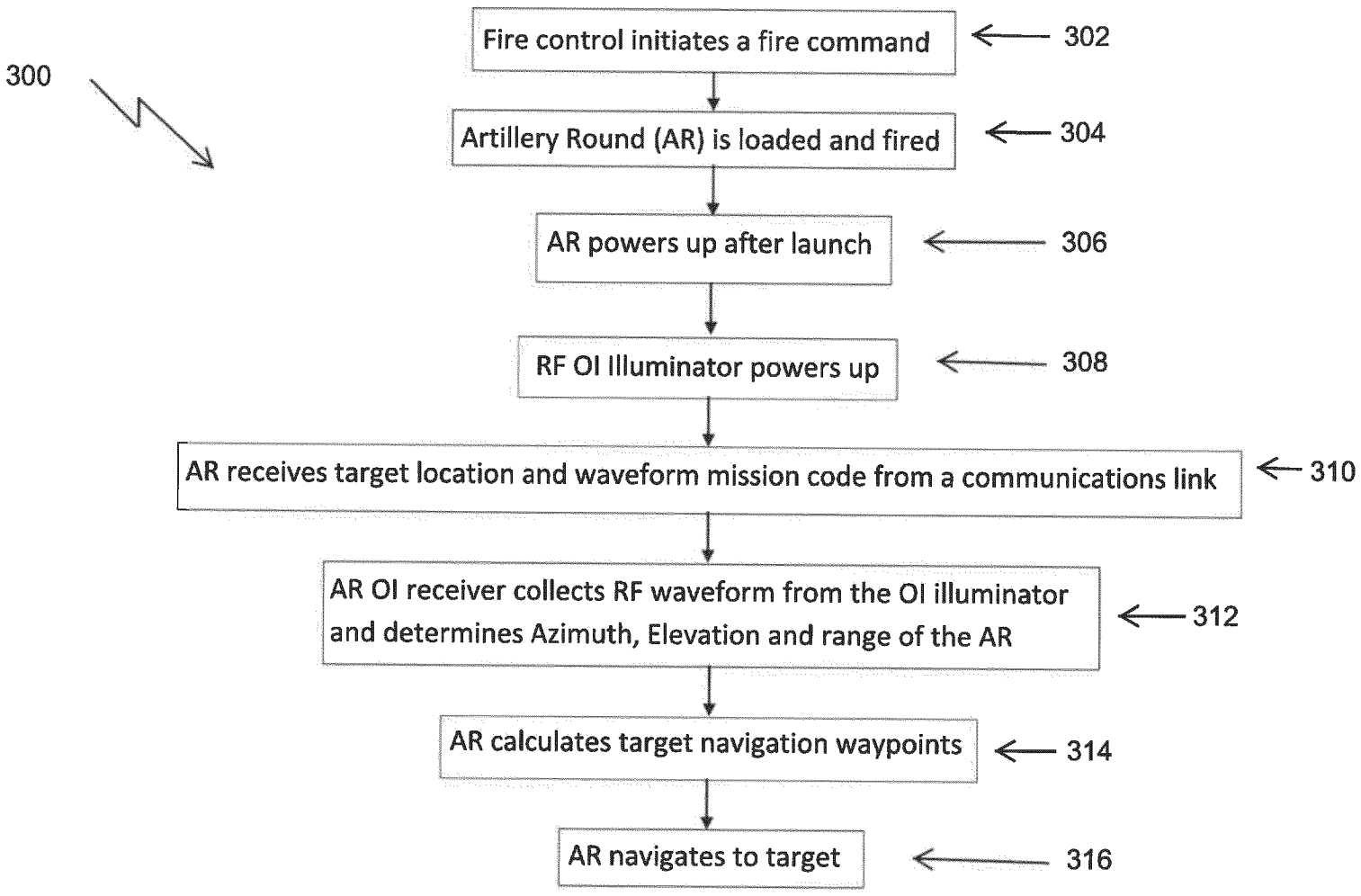
FIG. 3 is a flow chart of some of the functional elements for one embodiment of the system of the present disclosure.

FIG. 3 depicts a flow chart 300 of some of the functional elements prior to any hand-off for one embodiment of the system of the present disclosure. More specifically, in this embodiment, a fire control system initiates a fire command for a single asset 302. In this case, the asset is an artillery round (AR) or other munition. The AR is then loaded and fired 304. The AR is powered up after launch 306. In some embodiments, the AR has a rear-facing RF detector. In some cases, the AR has a communications module for receiving and/or transmitting information to a fire control system allowing updated commands and information. In certain embodiments, the AR has an on-board processor, memory, and/or additional detectors for use in guidance of the AR to a target, particularly for the terminal guidance. In this example, the RF/OI illuminator powers up after the launch of the AR 308 or is already powered up and projecting the frame having waveforms that are received by the AR. While it can be pre-programmed prior to launch, in one embodiment the AR receives updated target information and mission code data from an RF communication link 310 after launch. The RF detector on the AR also collects the RF/OI waveform data from the RF/OI illuminator and determines the azimuth and elevation data, and processes range data from the RF communications link to provide guidance instructions to bring the projectile to the target 312. The AR in one example calculates target navigation waypoints 314 as it navigates to the target 316. If there is a hand-off to a short term guidance system, the short term guidance may use the waypoints but also is able to switch to the short term guidance system such as the SAL seeker or imaging system. If unable to use the short term guidance system, the projectile can continue to use the calculated target navigation waypoints.

Figure 4:
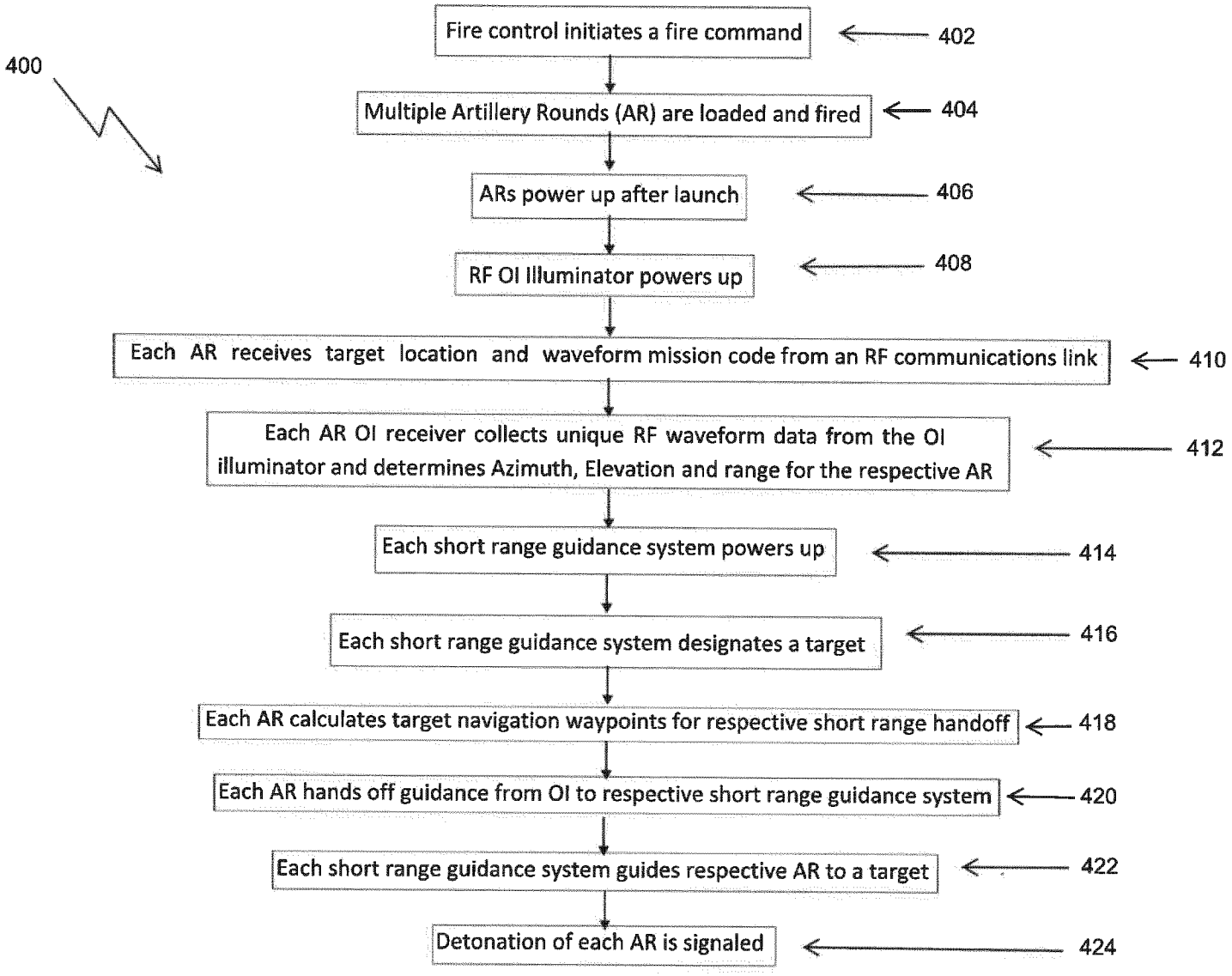
FIG. 4 is a flow chart of some of the major functional elements for another embodiment of the system of the present disclosure for guiding multiple assets.

FIG. 4 depicts a flow chart 400 of some of the functional elements for one embodiment of the system of the present disclosure is shown. More specifically, in this embodiment, a fire control system initiates a fire command for multiple assets 402. The fire control system in one example is a separate unit apart from the RF/OI illuminator but in other examples they are integrated together. In this case, the assets are artillery rounds (ARs) or other munitions. The ARs are loaded and fired 404 such as from a launcher. The ARs are generally powered up after launch 406, although in some cases the electronics are powered up prior to launch to obtain initial target information and mission data. In this embodiment, the AR has a rear-facing RF detector that allows reception of the RF/OI waveforms the form the reference frame as well as RF communications such as updated mission codes and target data. In one example the RF communications enables processing of the range information. In some cases, the AR has a communications module for receiving and/or transmitting information to the fire control system. In certain embodiments, each AR has an on-board processor, memory, and/or additional detectors for use in guidance of the AR to a target. As detailed herein, the RF/OI illuminator projects the reference frame and is either powered up after the launch of the ARs 408 or may be already powered up and projecting the frame for subsequent AR.

In some embodiments, multiple rounds are coordinated in one RF/OI reference frame. In some cases a full battery of Howitzers, or the like, are used and each round has customized trajectories for the particular target type or for masking the round's location. In some cases this is limited to the weapons control authority. Artillery with a limited control authority only maintains the pure ballistic trajectory, thereby limiting the curve one can add to the flight path. Mortars with larger control features can be aimed off target by several degrees and brought back on the correct flight path to engage the target. The Azimuth induced curve in the flight path provides a false launch location from the counter battery radar.

In certain embodiments, the RF/OI reference frame is extended to about 100 km and provides location to within about 100 m. In some cases the reference frame is extended to about 50 km and provides location to within about 50 m. The system utilizes one way illumination with rear-looking antennas on the projectiles and provides for jam hardening capability.

In some cases the round may be programmable during the initial flight path, which can reduce the time to fire. By equipping the RF/OI reference frame with a high quality north seeker, the system allows for "on the go" alignment for all of the rounds. No azimuth aiming is required with the RF/OI reference frame, and only minimal elevation adjustment is needed to account for a range differential. The RF/OI can be designed to cover various fields of engagement. In some cases, the field of engagement may be 10, 20 or 30 degrees.

Still referring to FIG. 4, each of the multiple rounds receives target information and unique waveform mission codes from an RF communication link, or the like 410. An RF detector on each AR collects the RF/OI waveform data from the RF/OI illuminator and determines the azimuth and elevation, and uses asset data to obtain the range from each asset to the target 412. The RF/OI method requires only minimal electronics cost to be embedded into each round, such as an RF receiver and RF apertures. In certain cases, the system hands off the guidance for the multiple rounds at about six to ten km from the target to a short range guidance system. Each short range guidance system powers up 414 and each short range guidance system designates a target 416. Each AR calculates target navigation waypoints along the flight path for use in a respective short range hand-off 418. In one embodiment the AR switches AR guidance from the RF/OI system to a respective short range guidance system 420 as the projectile approaches the target and is unable to stay connected with the RF/OI illuminator. Each short range guidance system guides a respective AR to a target 422. Detonation of the AR can be signaled 424 or can be internal such as timed, altitude or otherwise. In some cases, the detonation is signaled by a fire control system. In other cases, detonation is signaled by the short range guidance system at a certain distance. In some cases, detonation is signaled by the short range guidance system at a certain time point or Height of Burst (HOB) sensor.

In one example, the RF/OI illuminator's guidance of a munition is handed off to a SAL seeker, or the like. There, the round is equipped with laser detection ROIC or the like. In some cases, the short range guidance system is small, e.g., about 1 $in^3$, including the optics. In one embodiment, the SAL seeker is capable of detection at 10 km with 1 mrad target angle error with a FOV ranging from 40 to 70 degrees. In certain embodiments, a SAL seeker located on the front of the asset is guided by a designator (laser) coming from a forward observer on the ground, a UAV, or an aircraft. In some cases, the SAL seeker is equipped with full counter countermeasure (CCM) filtering with spatial and temporal filtering and/or full pulse repetition frequency (PRF- used to distinguished between multiple designators) and pulse interval modulation (PIM - used in a heavy jammer environment) decoding with multiple designators within the FOV.

In some cases, the RF/OI illuminator's guidance of a munition is handed off to an image based homing and navigation system. In certain embodiments, the short range guidance system utilizes image ATR (automatic target recognition). ATR is generally better suited for fixed targets, including, but not limited to buildings or structures. A series of images are stored in a database and either loaded onto a round or accessible by a round. The images are for areas of interest and/or for particular types of assets. When a round is within a certain range, the round can "recognize" the target form the images stored in the library. In some cases the library of images comprises items viewed at a distance of 40-50 meters. The imagery can be used to refine the weapons aimpoint to hit a specific place on target (section of a building) or look for a type of target in an open area (tank, artillery, etc.).

In some cases, the RF/OI illuminator's guidance of a munition is handed off to an IMU during the final four to five seconds, or the terminal phase. In some cases, this method is utilized in a grid pattern for area bombing. The RF/OI can be used to calibrate the IMU drift prior to engagement thereby reducing cost and maintaining weapon accuracy.

In one embodiment of the system of the present disclosure, a combination RF/OI and EO/IR precision guidance system is used to provide focused fire, where six to ten rounds are used for a single target. In some cases, the RF/OI reference frame is used for flight management of the six to ten rounds while they are "in flight" and the EO/IR system is used for terminal guidance. In certain cases the EO/IR system has a 30 μrad guidance loop. On short range trajectories, five to ten km, where direct line of sight (LOS) is feasible, the EO/IR system can be utilized to prosecute the final stages of the terminal guidance by tracking both the round with a laser/projectile retroreflector and the target with EO/IR imagers and thereby sending course corrections to the projectile/weapon by a communications link. The extreme precision of the EO/IR system can used to close the target error by < 100 urads.

In some cases, the combined RF/OI and EO/IR system is used as a flight management system where 1 to 25 rounds are managed in flight and each is managed to a unique grid point in the RF/OI reference frame. This eliminates energetics and cross impact be maintaining the ballistic trajectories. In some cases, the OI reference frame is aligned with EO for target tracking.

In another embodiment of the system of the present disclosure, a RF/OI precision guidance system is used to provide for counter swarm use, where a two-way RF/OI reference frame is used for flight management with a 10 to 20 round "in flight" capability. In some cases, this can be done with a continuous rate of fire of about one to two Hz. In certain embodiments, the RF/OI is also used for terminal guidance with a 200 μrad guidance loop.

In yet another embodiment of the system of the present disclosure, a combination RF/OI and EO/IR precision guidance system is used to provide for area suppression, where the RF/OI reference frame is used for flight management with an "in flight" capability of six to ten rounds and the RF/OI system is used for terminal guidance with a one mrad guidance loop for area suppression and the EO/IR system is used for terminal guidance for engagement with multiple individual targets (e.g. vehicles).

Figure 5:
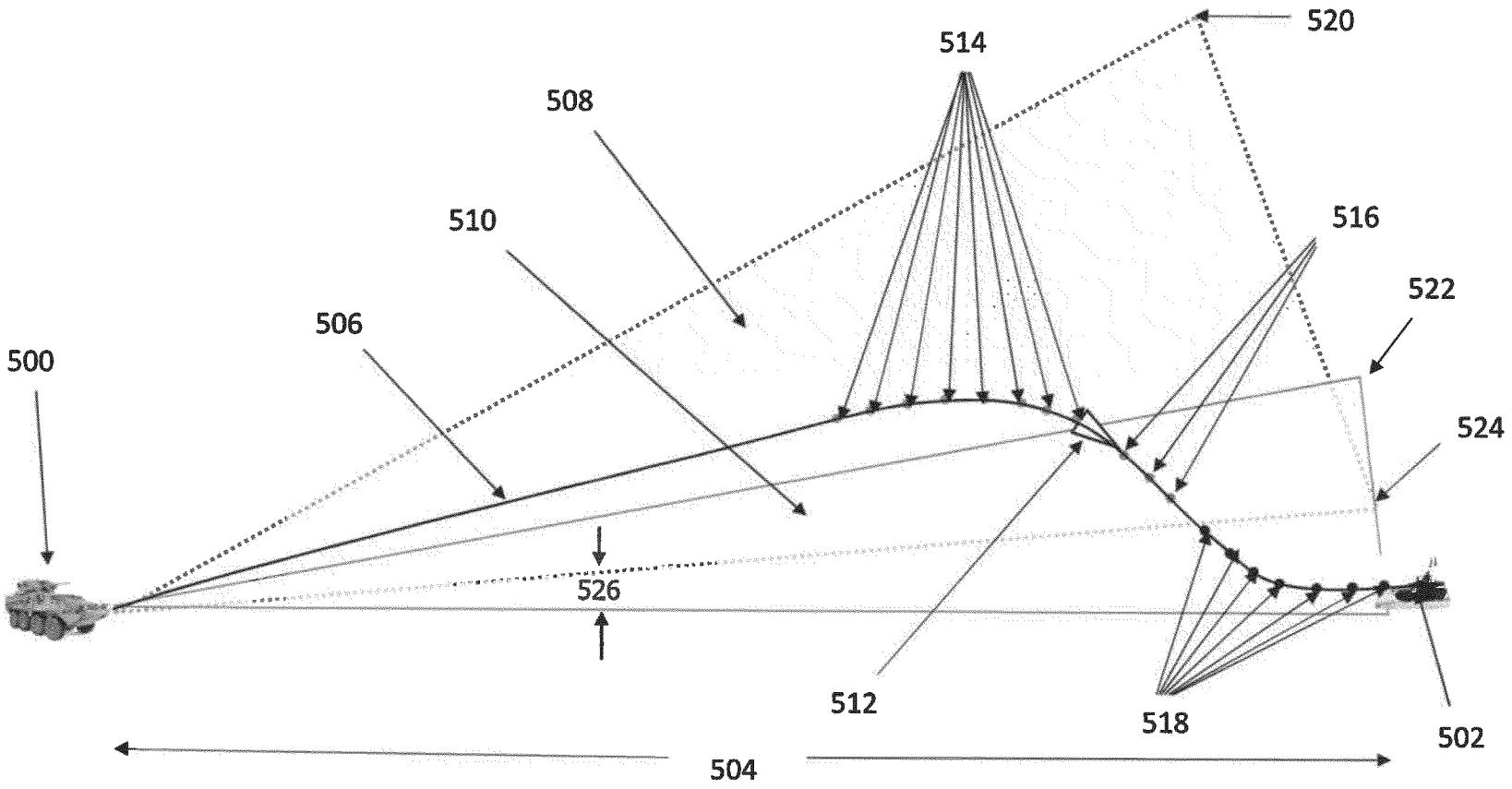
FIG. 5 is a diagram of one embodiment of the system of the present disclosure showing the combination guidance system.

Referring to FIG. 5, a diagram of one embodiment of the system of the present disclosure showing the combination guidance system is shown. More specifically, one or more munitions are launched form a launch area 500 and are directed at one or more targets 502. The one or more targets are a distance 504 away from the launch area. In some cases, the distance is about five km. The munitions travel along a flight path or trajectory 506. Here, the trajectory is conceptual, and is not to scale. The one or more munitions are tracked and guided using a combination system as detailed herein. An RF/OI reference frame 508 is used for flight management, and terminal or short range guidance is accomplished with a short term guidance systems 510 such as an EO/IR system.

In some cases, the RF/OI system has 5 GHz diversity at 100 steps - 50 MHz each. This maintains a 200 MHz ADC sampling rate at a low cost. The RF/OI system has accuracy at a distance of 5 km of about ± 5 m range, and ± 1 mrad for azimuth and elevation. The first portion of the flight management's projectile navigation waypoints 514 is governed by the RF/OI system which has about 12° by 10° coverage. In certain embodiments, the one or more munitions experience a hand-off point 512 where guidance is transitioned from the RF/OI system to the terminal guidance of the short term guidance systems 510 as the RF/OI system may not be available all the way to the target. The combined guidance portion is denoted 516 representing that portion of the projectile navigation waypoints, and transitions to short term guidance systems only flight management projectile navigation waypoints 518, where the EO/IR system has about a 2° by 2° FOV. The EO/IR terminal guidance has accuracy at 5 km of about ± 5 m and 0.3 mrad azimuth and elevation.

Still referring to FIG. 5, the distance above a plane upon which the one or more targets are located is represented by 520 for the top boundary of the RF/OI reference frame, the top boundary of the short term guidance such as EO/IR region 522, and 524 for the bottom boundary of the short term guidance reference frame 524. Thus, the region between 522 and 524 is the combined RF and EO region, and this region represents about 0.8° angle 526. In some cases, the receiver of the target operates at about one to two GHz and is configured to cancel out signals bounced off the earth and the like (e.g., multipath).

Figure 6A:
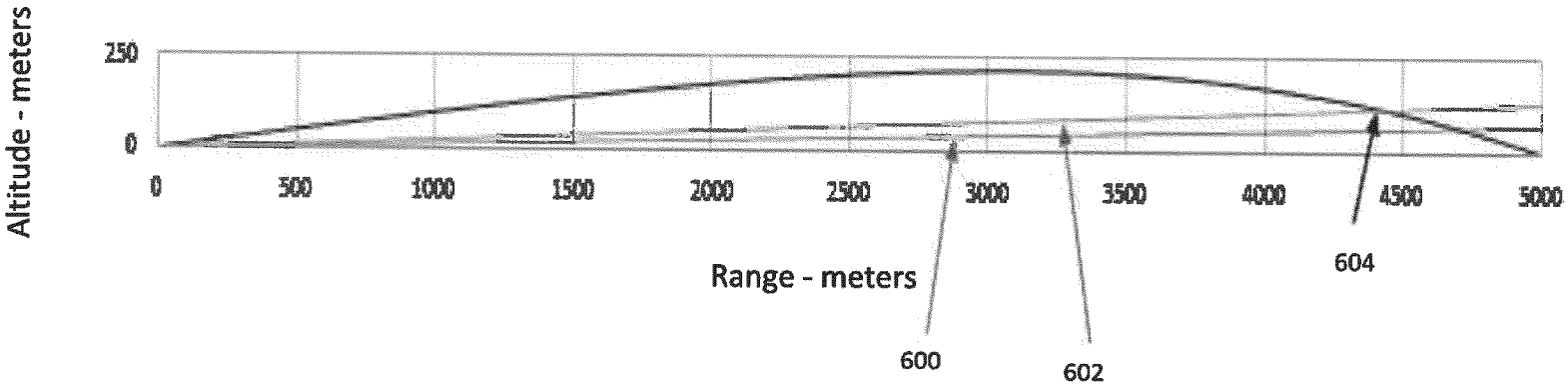
FIG. 6A is a diagram of one embodiment of the system of the present disclosure showing a munition and an exemplary trajectory.

Referring to FIG. 6A, a simulated diagram of one embodiment of the system of the present disclosure showing a munition and an exemplary trajectory is shown. More specifically, a flight path is shown where the RF/OI system is responsible for flight management above the 600 line and the short term guidance system is responsible for flight management below the 602 line. The zone between 600 and 602 is dual (RF and EO) guidance coverage. In this example, the handoff 604 is 4.5 m error handoff, or 2.27 seconds prior to impact.

Figure 6B:
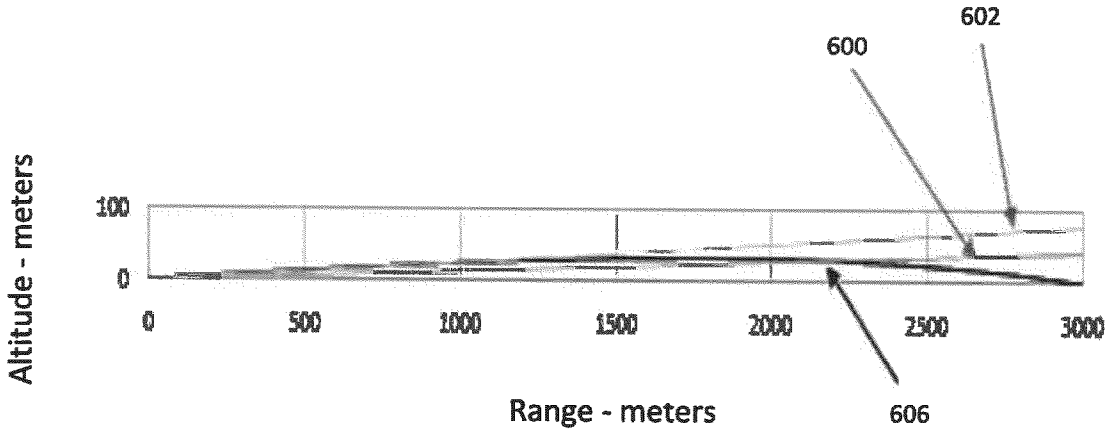
FIG. 6B is a diagram of one embodiment of the system of the present disclosure showing a munition and an exemplary trajectory.

Referring to FIG. 6B, a simulated diagram of one embodiment of the system of the present disclosure showing a munition and an exemplary trajectory is shown. More specifically, a flight path is shown where the RF/OI system is responsible for flight management above the 600 line and the EO/IR system is responsible for flight management below the 602 line. The zone between 600 and 602 is dual (e.g., RF and EO) guidance coverage. In this example, the handoff 606 is a 2.5 m error handoff, or 1.9 seconds prior to impact. In certain embodiments, the RF system provides top cover flight management for about 85% - 90% of the range to target and the EO terminal guidance is then simplified for the remaining one to two seconds prior to impact.

Figure 7:
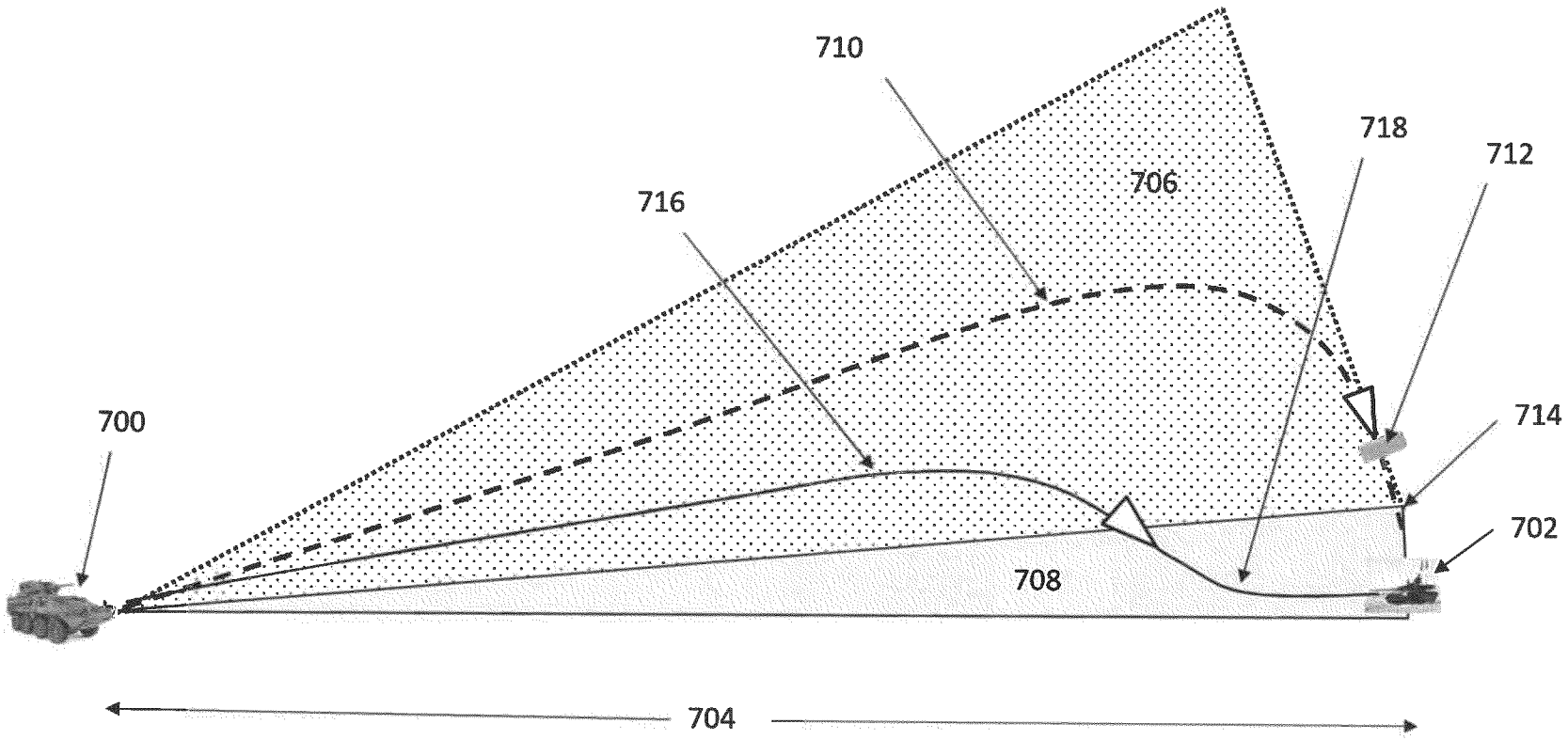
FIG. 7 is a diagram of one embodiment of the system of the present disclosure showing the combination guidance system.

Referring to FIG. 7, a diagram of one embodiment of the system of the present disclosure showing the combination guidance system is shown. More particularly, one or more munitions are fired from a launch area 700 and fly along a flight paths 710, 716 to one or more targets 702 a distance away 704 from the launch area 700. The combined guidance system comprises an RF/OI reference frame 706 and a, short term guidance region 708. As noted before, the trajectory shown is conceptual and not to scale.

Still referring to FIG. 7, the upper flight path 710 represents the path of one or more munitions being guided by the RF/OI reference frame such as in an area suppression maneuver. The command guidance 712 for a top attack is something akin to a grid with an accuracy at five km of about ±three m range and ±one mrad azimuth and elevation. The boundary between the RF/OI reference frame and the short term guidance region is about 130 m 714 in this embodiment. The lower flight path 716 represents guidance with initial the RF/OI reference frame and terminal guidance by the short term guidance system. In certain embodiments, the command guidance for the EO/IR short term guidance is line of sight and has accuracy at 5 km of about ± 0.03 mrad azimuth and elevation and ± 0.15 m range.

Figure 8:
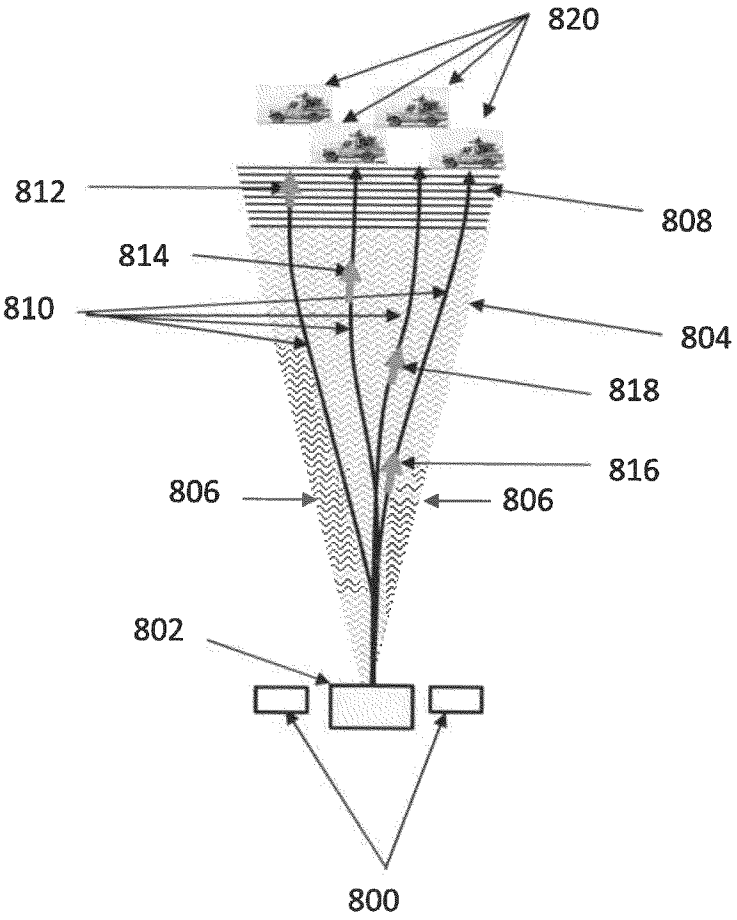
FIG. 8 is a diagram of one embodiment of the system of the present disclosure the showing the combination guidance system for multiple targets.

Referring to FIG. 8, a diagram of one embodiment of the system of the present disclosure showing the combination guidance system for multiple targets is shown. More particularly, in one embodiment of the present disclosure a transition from RF flight management to EO terminal guidance is accomplished. An EO/IR fire control 802 located in or near the launch area as well as a plurality of RF/OI antennas 800. A plurality of munitions (812, 814, 816, 818) are sequentially fired and they travel along unique flight paths 810 to a plurality of targets 820. In some cases, the RF top cover 804 has about an 11° FOV 806.

Still referring to FIG. 8, sequenced EO/IR terminal control is used in some embodiments, where the EO/IR guidance occurs at about one to two seconds prior to impact 808. In some cases, there are two SWIR tracker modes. In one, a single target is hit with multiple rounds with ± 30 μrads accuracy. In another, multiple targets (as depicted in the figure) are hit with multiple rounds with ± 75 μrads accuracy. In some cases, a laser tracker is used. In some embodiments, the laser is about 0.3 to about 1 mJ, about 200 Hz, 1.5 μm fiber laser with greater than about a 2° FOV. In some embodiments, a greater than about a 4° FOV is possible with the use of a see spot camera. Laser divergence may be about two by two mrads. In some cases, field adjustment can be made by moving the fiber tip with a step positioner, for example, at about 1 Hz to about 100 Hz.

For sequential round control, the munitions receive the RF identification code for unique control of each round. The projectile receives range codes for range calibration and determines the range by 1000 m to an accuracy of about ± 3 m in the RF reference frame. The projectile receives target OI position in the reference frame and its range from the munition. The projectile in this example confirms all instructions with fire control. In one example a plurality of projectiles are instructed to form a grid pattern to cover a certain region of interest. In another example, the targets are prioritized and the projectiles are directed to the highest priority targets.

Figure 9:
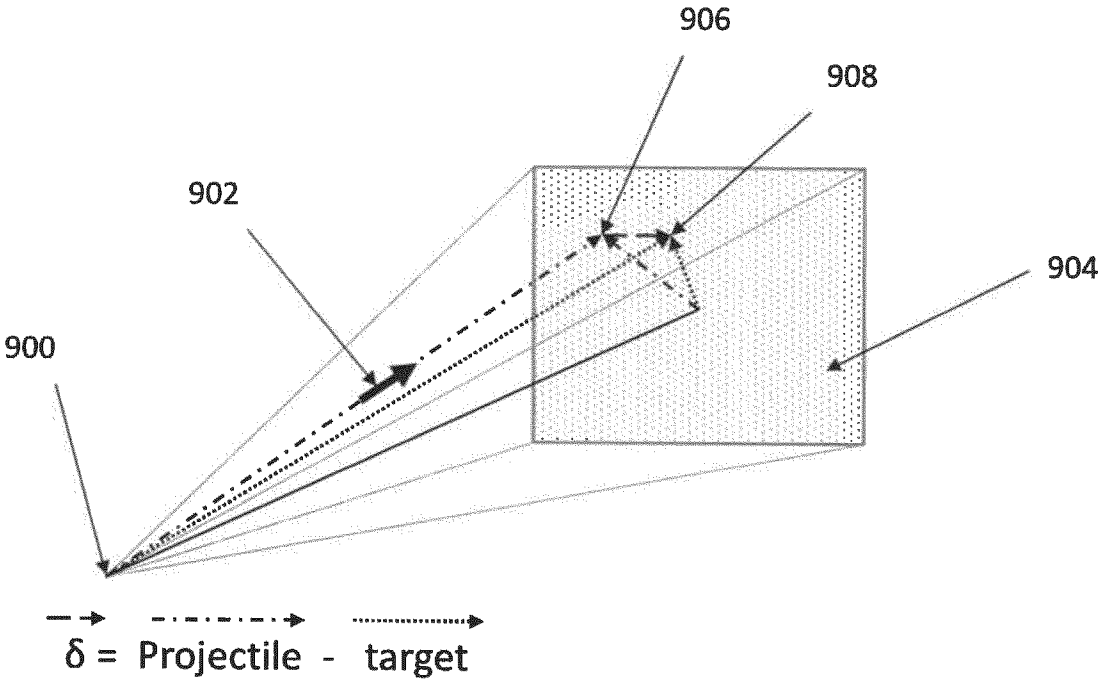
FIG. 9 is a diagram of one embodiment of the use of orthogonal interferometry to track a projectile and target in a reference frame.

Referring to FIG. 9, a diagram of one embodiment of the use of orthogonal interferometry to track a projectile and target in a reference frame is shown. More specifically, a projectile or munition 902 is fired from a launch area 900 and is tracked via an RF/OI reference frame 904. There are continuous updates for the current target location, which accounts of the OI frame structure motion, a moving target, and vehicle movement. Delta (δ) is determined by knowing current location of the projectile versus the target angular location, which is decomposed into azimuth and elevation vectors. The bandwidth of one embodiment of the system is 200 Hz. The projectile OI coordinate 906 and the target OI coordinate 908 are shown. In one embodiment, the OI lines/bins are 11° by 7° FOC coverage, thus 11° * 17.4/1 = 191 bins by 7° * 17.4/1 = 122 bins. The number of bins can be adjusted on larger or smaller FOVs to provide the needed precision for the given application. These systems can be coupled together to provide additional FOV coverage with a simple temporal and frequency method and in theory provide 360 degrees of coverage.

Figure 10:
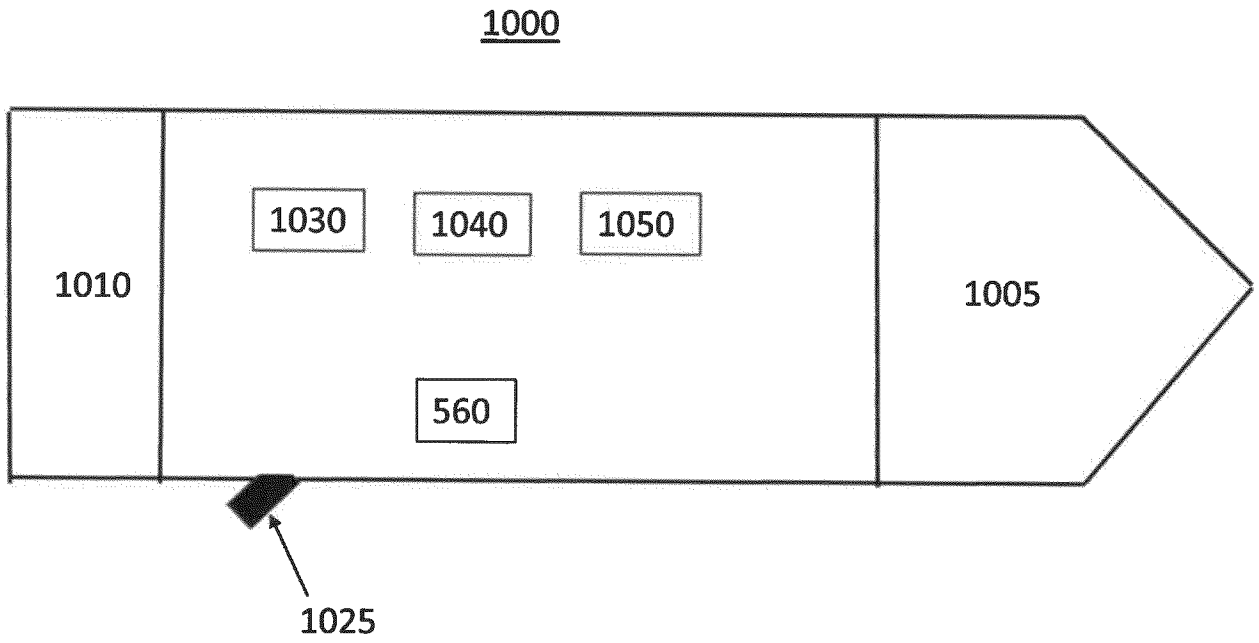
FIG. 10 is a depiction of the projectile according to one embodiment.

Referring to FIG. 10, a perspective view of the projectile 1000 is shown that employs the RF/OI processing for navigation and guidance to the target. The projectile 1000 can be a missile, rocket, artillery round or similar guided munition. The projectile has a front portion 1005 that that typically houses the warhead and fuze elements such that the fuze detonates the warhead at the appropriate point for the desired result. On the rear or tail portion of the projectile 1010 is an optional rocket engine that can be deployed to provide thrust to extend the range of the projectile. In one example, the projectile is launched without a rocket engine such as from a launch platform that achieves a certain altitude and is guided to the target. Examples of launch platforms include anti-tank guns, mortars, howitzer, field guns and railguns. The projectiles from the launch platforms may or may not have a rocket engine.

Referring again to FIG. 10, the midsection tends to house the electronics, communications, and guidance/navigation systems. A rear facing antenna 1025 is typically use to obtain the RF/OR waveforms for the reference frame that enable determination of the azimuth and elevation with respect to the illumination system. In one example, the processing involving firmware/software is performed on one or more processors that execute software residing on memory that is coupled to the processors. While labels are placed on certain items for descriptive purposes, the processing may be all done on a circuit card for have the processing technology. In this example an RF receiver 1030 is coupled to the antenna 1025. The RF receiver 1030 has a downconversion stage to process the analog inputs from the antenna and may include mixer(s), filter(s) and low noise amplifier(s) to process the analog signals. The downconverted signals are input to an analog-to-digital converter (ADC) to provide digital information that is then processed by one or more processing units such as in a digital signal processor.

A short range guidance section 1040 is used when the projectile reaches a hand-off point near the terminal end of the trajectory near the target area. The short range guidance section 1040 in one example is a SAL seeker that receives a signal such as reflected laser signal from the target. Another example is an imaging section that uses a camera to view the target area and compares the captured image to stored images to identify the target and. In yet a further example, since the projectile is close to the target and was tracking to the target, an inertial measurement unit (IMU) can be used to keep the projectile in a proper orientation and path to the target.

A guidance, navigation and control section 1050 is the digital processing section and is coupled to memory containing various instruction and routines and controls certain operation of the projectile. The signal processing of the OI includes decoding against a particular code and exploiting the cross-correlation suppression of the orthogonal coded waveforms. The azimuth and elevation data is obtained from the decoding. The RF communications such as the mission data and range data are also processed by the digital signal processor. Guidance information from the short range guidance section 1040 is processed and control instructions are generated to direct the projectile to the target.

A control actuation system (CAS) 1060 receives guidance controls and instructions to manipulate fins and canards (not shown) to steer the projectile. If the projectile has a rocket engine, that can also be employed to assist in reaching the target.

It will be appreciated from the above that portions of the invention may be implemented as computer software, which may be supplied on a storage medium or via a transmission medium. It is to be further understood that, because some of the constituent system components and method steps depicted in the accompanying Figures can be implemented in software, the actual connections between the systems components (or the process steps) may differ depending upon the manner in which the present invention is programmed. Given the teachings of the present invention provided herein, one of ordinary skill in the related art will be able to contemplate these and similar implementations or configurations of the present invention.

It is to be understood that the present invention can be implemented in various forms of hardware, software, firmware, special purpose processes, or a combination thereof. In one embodiment, the present invention can be implemented in software as an application program tangible embodied on a computer readable program storage device. The application program can be uploaded to, and executed by, a machine comprising any suitable architecture. The computer readable medium as described herein can be a data storage device, or unit such as a magnetic disk, magneto-optical disk, an optical disk, or a flash drive. Further, it will be appreciated that the term "memory" herein is intended to include various types of suitable data storage media, whether permanent or temporary, such as transitory electronic memories, non-transitory computer-readable medium and/or computer-writable medium.

While various embodiments of the present invention have been described in detail, it is apparent that various modifications and alterations of those embodiments will occur to and be readily apparent to those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed is:

1. A combined navigation system, comprising:

a radio frequency orthogonal interferometry array providing radio frequency orthogonal interferometry waveforms projected towards a target area and to further provide radio frequency (RF) communications, wherein the radio frequency orthogonal interferometry waveforms generate a reference frame that establishes a top boundary and a bottom boundary;

at least one projectile configured to receive the radio frequency orthogonal interferometry waveforms and the RF communications, wherein the RF communications comprises at least one of range information and mission information;

a short range guidance system on the at least one projectile configured to provide guidance of the projectile from a hand-off point to the target area, wherein the hand-off point is at a time before the target reaches the bottom boundary of the reference frame; and a non-transitory computer-readable storage medium carried by the projectile having a set of instructions encoded thereon that when executed by one or more processors, provide guidance and navigation of the projectile, the set of instructions being configured to cause the one or more processors to perform:

processing azimuth and elevation information from the radio frequency orthogonal interferometry waveforms;

processing the at least one of range information and mission information from the RF communications;

determining coordinates of the projectile using the azimuth, elevation and range information, wherein the coordinates are relative to the radio frequency orthogonal interferometry array;

guiding the projectile along a trajectory within the reference frame to the hand-off point;

switching to the short range guidance system at the hand-off point; and guiding the projectile from the hand-off point to the target area using the short range guidance system.

2. The combined navigation system according to claim 1, wherein the radio frequency orthogonal interferometry array is aligned via a north finding device.

3. The combined navigation system according to claim 1, wherein the instructions are further configured to process one or more navigation waypoints for the short range guidance system.

4. The combined navigation system according to claim 1, wherein the instructions are further configured to process one or more navigation waypoints prior to the hand-off point.

5. The combined navigation system according to claim 1, further comprising detonating the at least one projectile in a grid pattern proximate the target.

6. The combined navigation system according to claim 1, wherein the short term guidance system is a semi-active laser seeker.

7. The combined navigation system according to claim 1, wherein each of the at least one projectile is provided unique mission information from the RF communications.

8. A computer program product including one or more non-transitory machine-readable mediums with instructions encoded thereon, that when executed by one or more processors cause a process for guidance and control of one or more projectiles to be carried out, the process comprising:

receiving mission data and range information from an RF communications link;

processing, via a radio frequency (RF) receiver on the one or more projectiles, radio frequency orthogonal interferometry waveforms obtained from a reference frame, the reference frame being generated by a radio frequency orthogonal interferometry array;

determining an azimuth and an elevation of the one or more projectiles from the radio frequency orthogonal interferometry waveforms and further determining a latitude and a longitude of the one or more projectiles using the range information;

guiding the one or more projectiles along a trajectory towards a target;

switching guidance of the one or more projectile to an electro-optical terminal guidance system at a hand-off point;

guiding the projectiles to the target using the electro-optical terminal guidance system; and detonating the one or more projectiles proximate the target.

9. The computer program product according to claim 8, wherein the one or more projectiles is a plurality of artillery rounds configured to use the mission information to form a grid pattern proximate the target.

10. The combined navigation system according to claim 7, wherein the at least one projectile is a plurality of artillery rounds configured to use the unique mission information to form a grid pattern proximate the target area.

11. The combined navigation system according to claim 1, wherein the mission information comprises at least one of orientation to earth coordinates, target location, target type, waypoints, and fusing parameters.

12. The combined navigation system according to claim 1, wherein the at least one projectile further comprises an RF receiver, a guidance navigation and control section, a control actuation system, a warhead, a fuze and at least one detector.

13. The combined navigation system according to claim 1, further comprising a rear facing antenna on the at least one projectile.

14. The combined navigation system according to claim 1, wherein the short range guidance system is at least one of a semi-active laser seeker, an inertial measurement unit, and an image based homing and navigation system.

15. The combined navigation system according to claim 1, wherein the at least one projectile is directed to the target without using a global positioning system (GPS).

16. The combined navigation system according to claim 1, wherein the polar coordinates are earth coordinates by orienting the radio frequency orthogonal interferometry array to an earth latitude/longitude grid.

17. The combined navigation system according to claim 1, further comprising a range tracking filter to obtain the range information.

18. The combined navigation system according to claim 1, wherein the short range guidance system is located on a front portion or a midsection of the at least one projectile.

* * * * *